US011700902B2

(12) United States Patent
Roberts

(10) Patent No.: US 11,700,902 B2
(45) Date of Patent: Jul. 18, 2023

(54) HELMET RETENTION SYSTEM

(71) Applicant: ArmorSource, LLC, Hebron, OH (US)

(72) Inventor: Donald F. Roberts, Newark, OH (US)

(73) Assignee: ArmorSource, LLC, Hebron, OH (US)

( * ) Notice: Subject to any disclaimer, the term of this patent is extended or adjusted under 35 U.S.C. 154(b) by 168 days.

(21) Appl. No.: 17/145,019

(22) Filed: Jan. 8, 2021

(65) Prior Publication Data

US 2021/0251328 A1 Aug. 19, 2021

Related U.S. Application Data

(60) Provisional application No. 62/922,245, filed on Jan. 8, 2020.

(51) Int. Cl.
*A42B 3/08* (2006.01)
*A42B 3/14* (2006.01)

(52) U.S. Cl.
CPC ..... *A42B 3/085* (2013.01); *A42B 3/145* (2013.01)

(58) Field of Classification Search
CPC ..... A42B 3/145; A42B 3/085; F41H 1/04; F41H 1/06; F41H 1/08
See application file for complete search history.

(56) References Cited

U.S. PATENT DOCUMENTS 2,649,019 A 8/1953 Hartline et al.
2,926,406 A 3/1960 Edwards et al.
3,028,602 A 4/1962 Miller
3,366,972 A 2/1968 Wise et al.
4,461,044 A 7/1984 Reiterman et al.
4,703,879 A 11/1987 Kastendieck
4,942,628 A 7/1990 Freund
5,551,094 A 9/1996 Navone
5,581,819 A 12/1996 Garneau
5,983,405 A * 11/1999 Casale ..... A42B 3/145 2/421
6,154,889 A 12/2000 Moore, III
6,256,798 B1 7/2001 Egolf
6,453,476 B1 9/2002 Moore, III
7,600,268 B2 10/2009 Rogers et al.
7,694,354 B2 4/2010 Philpott
7,770,239 B1 8/2010 Goldman et al.
7,950,073 B2 5/2011 Ferrara
(Continued)

*Primary Examiner* — Katherine M Moran
(74) *Attorney, Agent, or Firm* — Bryce D. Miracle, Esq.

(57) ABSTRACT

The present application discloses a helmet retention system for securing a helmet to the head of a user. In certain versions, the helmet retention system comprises a rear portion connected the rear of the helmet, a chin portion configured to receive the chin of the user, a first side upper strap extending from the rear portion to the front of the helmet, a second side upper strap extending from the rear portion to the front of the helmet, a first side lower strap extending from the rear portion to the chin portion, a second side lower strap extending from the rear portion to the chin portion, and an adjustment device operably attached to the rear portion. The adjustment device is configured to selectively and simultaneously adjust the length of the first side upper strap and the second side upper strap between the rear portion and the front of the helmet and simultaneously adjust the length of the first side lower strap and the second side lower strap between the rear portion and the chin portion.

25 Claims, 14 Drawing Sheets

(56) References Cited

U.S. PATENT DOCUMENTS

| | | | | |
|---|---|---|---|---|
| 7,950,112 | B2 | 5/2011 | Hammerslag | |
| 7,992,261 | B2 | 8/2011 | Hammerslag | |
| 8,056,150 | B2 | 11/2011 | Stokes et al. | |
| 8,156,574 | B2 | 4/2012 | Stokes et al. | |
| 8,353,066 | B2 | 1/2013 | Rogers | |
| 8,381,362 | B2 | 2/2013 | Hammerslag | |
| 8,424,168 | B2 | 4/2013 | Soderberg et al. | |
| 8,468,657 | B2 | 6/2013 | Soderberg et al. | |
| 8,516,662 | B2 | 8/2013 | Goodman | |
| 8,713,820 | B2 | 5/2014 | Kerns | |
| 8,984,719 | B2 | 3/2015 | Soderberg et al. | |
| 9,066,551 | B2 | 6/2015 | Van Waes | |
| 9,101,181 | B2 | 8/2015 | Soderberg et al. | |
| 9,125,455 | B2 | 9/2015 | Kerns et al. | |
| 9,138,030 | B2 | 9/2015 | Soderberg et al. | |
| 9,179,729 | B2 | 11/2015 | Cotterman et al. | |
| 9,204,678 | B1 | 12/2015 | Brachos et al. | |
| 9,259,056 | B2 | 2/2016 | Soderberg et al. | |
| D754,930 | S | 4/2016 | Vito | |
| 9,307,802 | B2 | 4/2016 | Hall | |
| 9,320,311 | B2 | 4/2016 | Szalkowski et al. | |
| 9,339,082 | B2 | 5/2016 | Hammerslag et al. | |
| 9,375,053 | B2 | 6/2016 | Burns | |
| 9,408,437 | B2 | 8/2016 | Goodman | |
| 9,480,293 | B2 | 11/2016 | Pfanner et al. | |
| 9,526,291 | B2 | 12/2016 | Beauchamp | |
| 9,572,392 | B2 | 2/2017 | Klotz et al. | |
| 9,629,417 | B2 | 4/2017 | Cavanagh | |
| 9,642,412 | B2 | 5/2017 | Klotz et al. | |
| 9,706,814 | B2 | 7/2017 | Converse et al. | |
| 9,743,701 | B2 | 8/2017 | Javorek et al. | |
| 9,743,714 | B2 | 8/2017 | Hammerslag et al. | |
| 9,770,070 | B2 | 9/2017 | Cotterman et al. | |
| 9,848,676 | B2 | 12/2017 | Maloney | |
| 9,854,873 | B2 | 1/2018 | Kerns et al. | |
| 9,867,430 | B2 | 1/2018 | Hammerslag et al. | |
| 9,894,953 | B2 | 2/2018 | Szalkowski et al. | |
| 10,039,348 | B2 | 8/2018 | Cavanagh et al. | |
| 10,070,695 | B2 | 9/2018 | Burns et al. | |
| 10,076,160 | B2 | 9/2018 | Burns et al. | |
| 10,123,589 | B2 | 11/2018 | Soderberg et al. | |
| 10,251,451 | B2 | 4/2019 | Converse et al. | |
| 10,412,845 | B2 | 9/2019 | Chang | |
| 10,413,019 | B2 | 9/2019 | Soderberg et al. | |
| 10,543,630 | B2 | 1/2020 | Hipwood | |
| 10,588,373 | B2 | 3/2020 | Staudinger | |
| 10,588,374 | B2 | 3/2020 | Maloney | |
| 10,595,578 | B2 | 3/2020 | Szalkowski et al. | |
| 10,634,923 | B2 | 4/2020 | Wang et al. | |
| 10,656,670 | B2 | 5/2020 | Hu et al. | |
| 10,660,404 | B2 | 5/2020 | Chen | |
| 10,681,953 | B2 | 6/2020 | Patel | |
| 2003/0106138 | A1 | 6/2003 | Guay | |
| 2011/0094018 | A1 | 4/2011 | Rogers | |
| 2011/0112448 | A1 | 5/2011 | Wu | |
| 2011/0277222 | A1 | 11/2011 | Garneau | |
| 2011/0277223 | A1 | 11/2011 | Roberts et al. | |
| 2013/0000016 | A1 | 1/2013 | Hall et al. | |
| 2013/0000017 | A1 | 1/2013 | Szalkowski et al. | |
| 2013/0086733 | A1 | 4/2013 | Szalkowski et al. | |
| 2013/0117913 | A1 | 5/2013 | Rogers et al. | |
| 2013/0239303 | A1 | 9/2013 | Cotterman et al. | |
| 2014/0096310 | A1* | 4/2014 | Szalkowski | A42B 3/145 2/421 |
| 2015/0305429 | A1* | 10/2015 | Javorek | A42B 3/145 2/421 |
| 2016/0165998 | A1 | 6/2016 | Musal et al. | |
| 2016/0270470 | A1 | 9/2016 | Hickman et al. | |
| 2017/0006949 | A1 | 1/2017 | Lacy et al. | |
| 2017/0006951 | A1 | 1/2017 | Venturini et al. | |
| 2017/0095028 | A1 | 4/2017 | Musal | |
| 2017/0367430 | A1 | 12/2017 | Javorek et al. | |
| 2018/0092424 | A1 | 4/2018 | Hall et al. | |
| 2018/0271199 | A1 | 9/2018 | Szalkowski et al. | |
| 2018/0325203 | A1 | 11/2018 | Cotterman | |
| 2018/0352908 | A1 | 12/2018 | Burns et al. | |
| 2019/0000189 | A1 | 1/2019 | Burns et al. | |
| 2019/0069641 | A1 | 3/2019 | Soderberg | |
| 2019/0216176 | A1 | 7/2019 | Converse et al. | |
| 2020/0008533 | A1 | 1/2020 | Hammerslag et al. | |
| 2020/0054097 | A1 | 2/2020 | Soderberg et al. | |
| 2020/0109920 | A1* | 4/2020 | Banducci | F41H 1/08 |
| 2020/0121017 | A1 | 4/2020 | King et al. | |
| 2020/0189158 | A1 | 6/2020 | Hipwood et al. | |
| 2020/0205523 | A1 | 7/2020 | Kawano | |
| 2020/0253315 | A1* | 8/2020 | Maloney | A42B 3/142 |
| 2021/0153594 | A1* | 5/2021 | Rogers | A42B 3/142 |
| 2022/0175074 | A1* | 6/2022 | Rietdyk | A42B 3/08 |
| 2022/0307801 | A1* | 9/2022 | Banducci | F41H 1/08 |

* cited by examiner

HELMET RETENTION SYSTEM

CROSS-REFERENCE TO RELATED APPLICATION

This application is based upon and claims the priority filing date of the previously filed, U.S. provisional patent application entitled "HELMET RETENTION SYSTEM" filed Jan. 8, 2020, having App. No. 62/922,245, the entire disclosure of which is hereby incorporated herein by reference.

BACKGROUND

The present invention relates to a helmet device, in particular a retention system for securing a helmet to a user.

Helmets are generally used in order to protect the head from blunt trauma or force sustained while the user is engaged in certain activities. In particular, a helmet typically comprises a hard outer shell configured to spread an impact force across the surface of the helmet, an inner liner for seating the top of the head into the helmet and providing further impact absorbent material, and a retention strap for securing the helmet to the head of the user.

SUMMARY

A helmet retention system for securing a helmet to a head of a user is generally disclosed herein. In a version of the application, the retention system generally includes a rear portion connected to the rear of the helmet; a chin portion configured to receive a chin of the user; a first side upper strap extending from the rear portion to the front of the helmet; a second side upper strap extending from the rear portion to the front of the helmet; a first side lower strap extending from the rear portion to the chin portion; a second side lower strap extending from the rear portion to the chin portion; an adjustment device operably attached to the rear portion configured to selectively and simultaneously adjust the length of the first side upper strap and the second side upper strap between the rear portion and the front of the helmet and simultaneously adjust the length of the first side lower strap and the second side lower strap between the rear portion and the chin portion. The first side upper strap and the second side upper strap each comprises a strap segment extending from the front of the helmet and an elongated flexible member movably attached to the strap segment and movable relative to the helmet shell. The first side lower strap and the second side lower strap each comprises a strap segment extending from the chin portion and an elongated flexible member movably attached to the strap segment and movable relative to the helmet shell. The elongated flexible members form a unitary length of material having a first and second end. The adjustment device is configured to selectively adjust at the first and second ends of the elongated flexible member to move each strap segment relative to the helmet shell and adjust the length of the first and second side upper straps between the rear of the helmet shell and the front of the helmet shell and adjust the length of the first and second side lower straps between the rear of the helmet shell and the chin portion.

In certain preferred versions, the rear portion further comprises a first side directional guide and a second side direction guide for providing directional guidance of the elongated flexible member from the first side upper strap to the first side lower strap and from the second side upper strap to the second side lower strap respectively.

In other versions of the application, the elongated flexible member extends laterally from the adjustment device movably attaching to a free end of the first side upper strap segment, returning and movably attaching to the first side directional guide, extending laterally away from the rear portion movably attaching to a free end of the second side lower strap segment, extending back towards the rear portion, extending laterally across the rear portion and movably attaching with the second side lower strap segment, returning and movably attaching to the second side directional guide, extending laterally away from the rear portion and movably attaching to the second side upper strap segment, and returning back to the adjustment device.

In yet other versions, the rear portion comprises an inner layer and an exterior layer forming an inner compartment, wherein the exterior layer comprises a first side and a second side upper lateral guides for providing directional guidance and limiting vertical travel of the elongated flexible member extending away from the adjustment device to the respective first and second side upper strap segments.

Further, it may be preferable wherein the first side and the second side upper lateral guides each comprise a plurality of laterally positioned guide holes providing ingress and egress to and from the inner compartment, wherein the elongated flexible member is woven from the adjustment device through a first guide hole leading to the inner compartment for a brief segment, then exiting through a second guide hole, then laterally to the respective first and second upper strap segments.

In other versions, the exterior layer may further include at least one lower side lateral guide for providing limiting vertical travel of the elongated flexible member extending between the first side lower strap segment to the second side lower strap segment.

In certain other versions of the application, the at least one lower side lateral guide comprises at least two laterally positioned guide holes providing ingress and egress to and from the inner compartment, wherein the elongated flexible member is woven from the first side lower strap segment through a first guide hole leading to the inner compartment for a brief segment, then exiting through a second guide hold, and extending to the second side lower strap segment.

These and other features of the present invention will become readily apparent upon further review of the following specification and drawings.

BRIEF DESCRIPTION OF THE DRAWINGS

These and other features, aspects, and advantages of the present invention will become better understood with regard to the following description and accompanying figures where.

DETAILED DESCRIPTION

Figure 1:
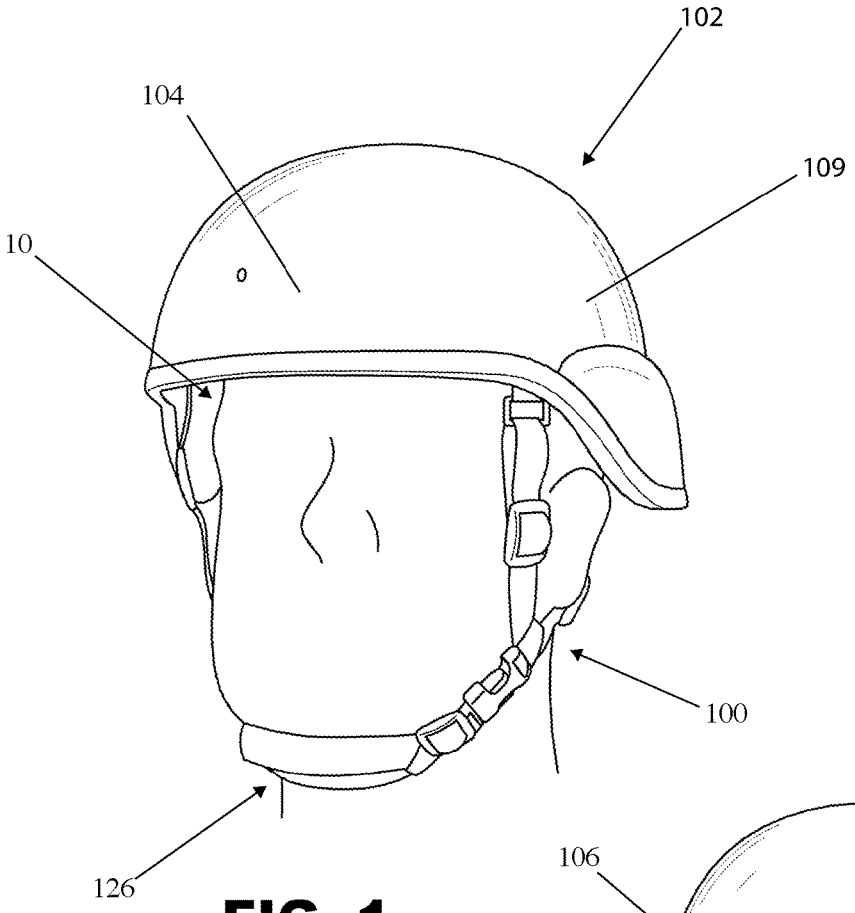
FIG. 1 is a front perspective view of a version of a helmet and retention system as worn on a user.
Figure 2:
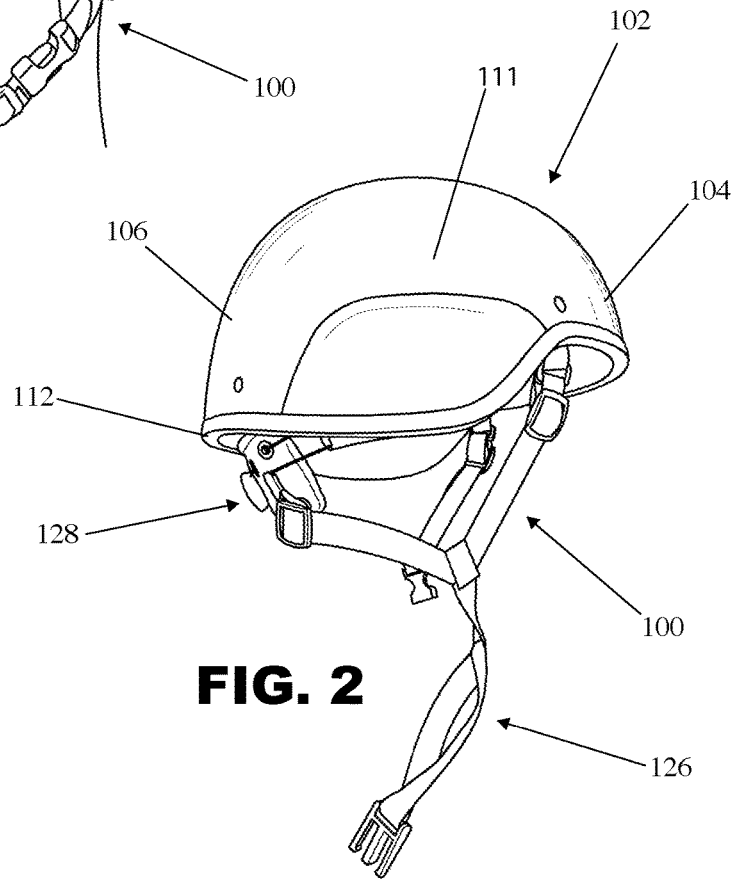
FIG. 2 is a right side elevation view of the helmet and retention system of the version shown in FIG. 1.
Figure 3:
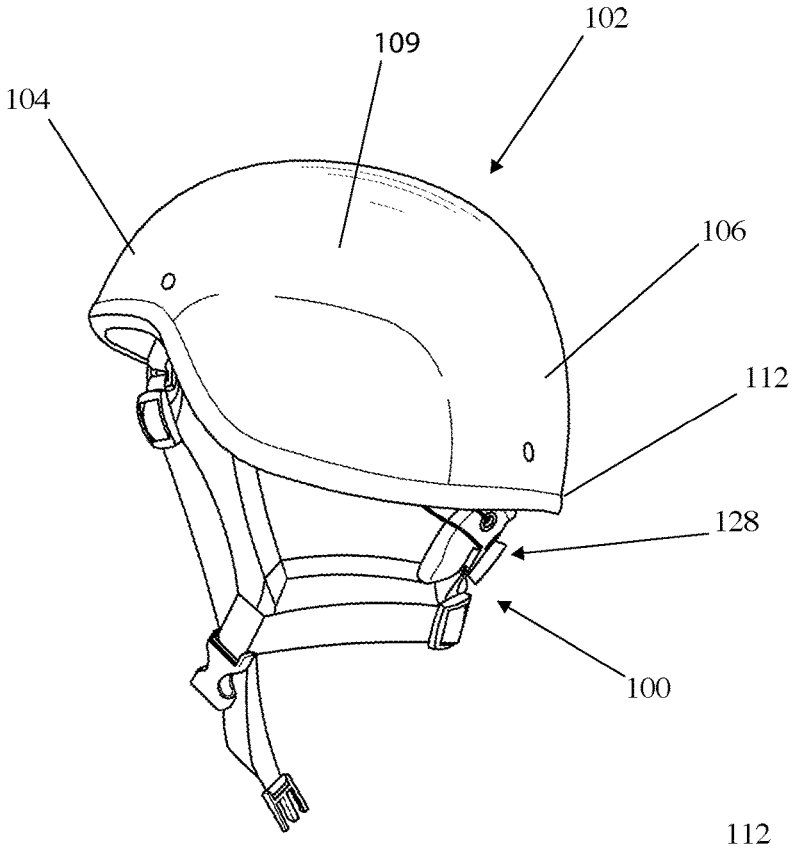
FIG. 3 is a left side elevation view of the helmet and retention system of the version shown in FIG. 1.
Figure 4:
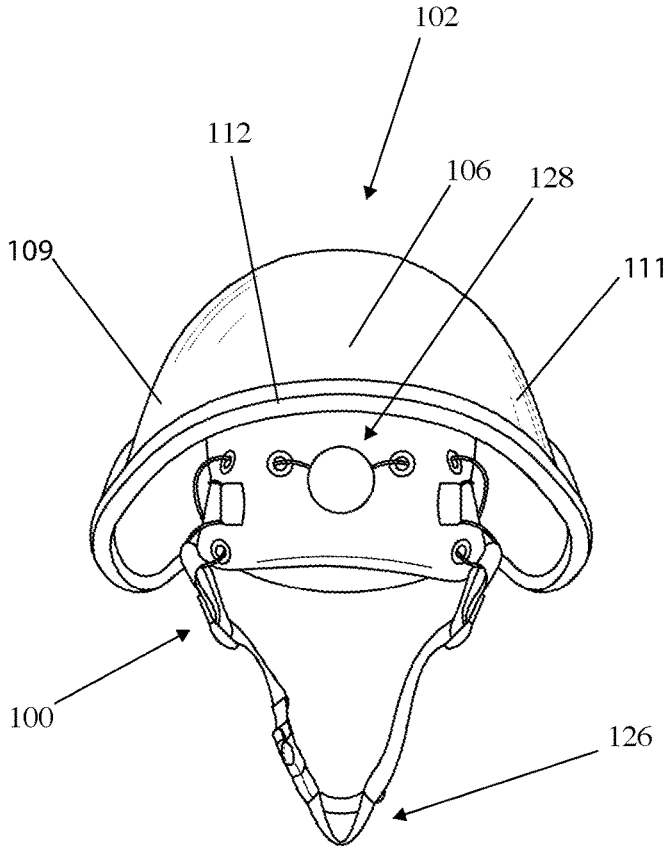
FIG. 4 is a rear elevation view of the helmet and retention system of the version shown in FIG. 1.

In the following description, for purposes of explanation and not limitation, specific details are set forth such as particular architectures, interfaces, techniques, etc. in order to provide a thorough understanding of the present invention. However, it will be apparent to those skilled in the art that the present invention may be practiced in other versions that depart from these specific details. In other instances, detailed descriptions of well-known devices and methods are omitted so as not to obscure the description of the present invention with unnecessary detail.

The following detailed description is of the best currently contemplated modes of carrying out exemplary versions of the invention. The description is not to be taken in the limiting sense, but is made merely for the purpose illustrating the general principles of the invention, since the scope of the invention is best defined by the appended claims. Various inventive features are described below that can each be used independently of one another or in combination with other features.

Referring now to the figures wherein the showings are for purposes of illustrating a preferred version of the invention only and not for purposes of limiting the same, the present application discloses a helmet shell, a retention system for securing the helmet to a user's head, and a method of adjusting a helmet by way of the retention system.

Referring to generally to FIG. 1-FIG. 4, a version of the retention system 100 is described for use with a military helmet shell 102 generally having a front side 104, a rear side 106, a left side 109, and a right side 111. For example, such military helmet shells may include a U.S. Army Advanced Combat Helmet, a U.S. Marine Corp Lightweight helmet, an Enhanced Combat Helmet, a Personal Armor System for Ground Troops helmet, or other ballistic helmet shells as is known. However, it will be known, the retention system may also be used with a variety of other helmets such as motorcycle helmets, cycling helmets, tactical helmets, sporting helmets, aircrew flight helmets, and safety helmets.

Figure 5A:
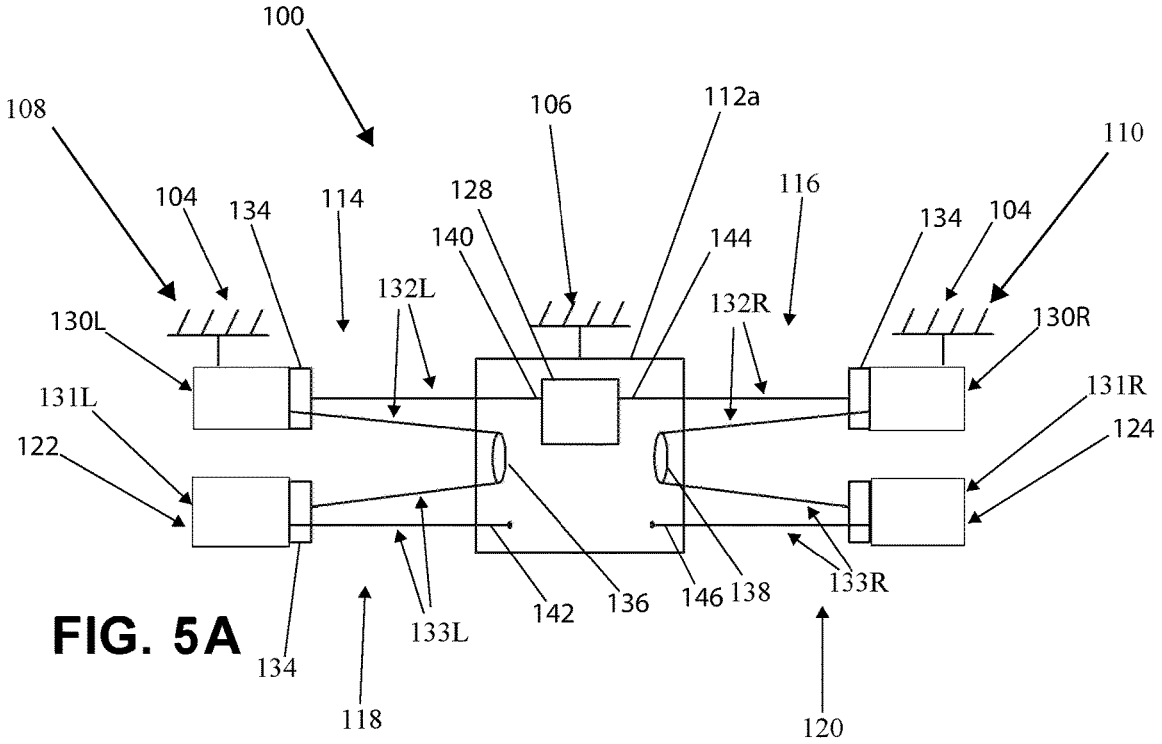
FIG. 5A is a schematic illustrating a helmet retention system in accordance with a first version of the present application.

Referring now to FIG. 5A showing a schematic illustrating the general components and principles according to a first version of the helmet retention system 100 for securing and stabilizing a helmet shell 102 to the head 10 of a user (FIG. 1). As shown, the helmet retention system 100 generally comprises a centrally positioned rear portion 112*a* connected to the rear side 106 of the helmet shell 102, a first side upper strap 114 and an opposing second side upper strap 116, each extending forward from the rear portion 112*a* of the helmet shell 102 toward the front 104 of the helmet shell 102, and a first side lower strap 118 and an opposing second side lower strap 120, each extending forward from the rear portion 112*a*, each terminating at a free end 122, 124 which are generally configured to be selectively connected forming a chin portion 126 which is operably configured to receive the chin 12 of the user providing an anchor point of the retention system. (See FIG. 1).

Figure 13:
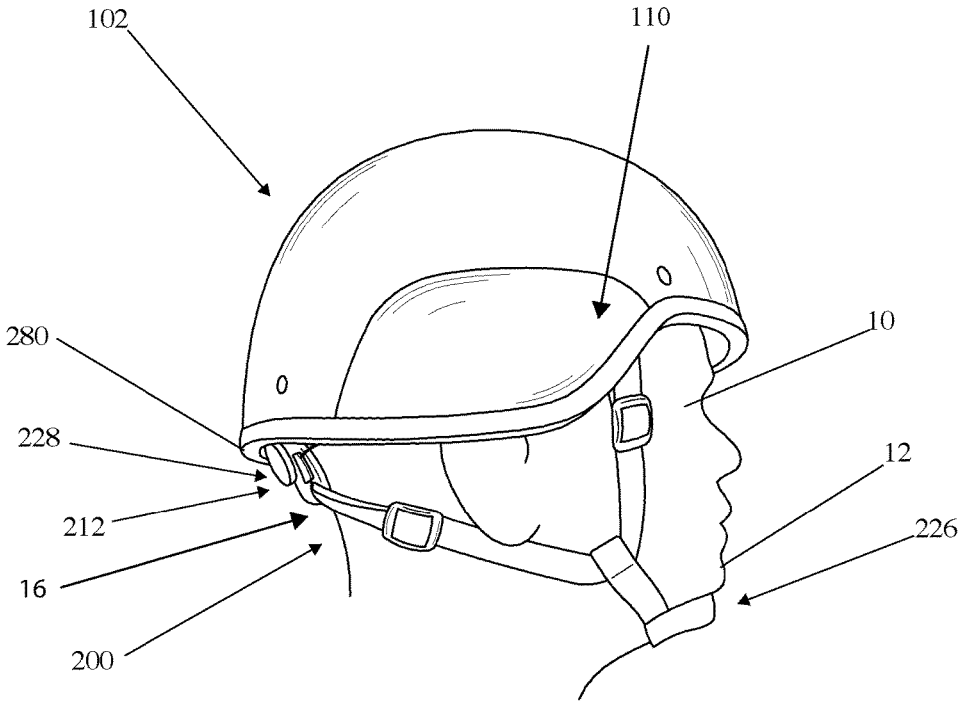
FIG. 13 is a right side view of the version of the helmet and retention system of the version shown in FIG. 6A.

The rear portion 112 of the retention system 100 is generally configured to contact the rear 16 of the user's head 10 (See FIG. 13) and acts as an anchor point of the system. The rear portion 112 may be a variety of shapes and sizes, for example, the rear portion 112 may be shaped as a triangle, square, rectangle, circle, or any other shape that provides an anchor point at the rear 16 of the user's head 10. The rear portion 112 may comprise padding material such as foam with a canvas covering or a breathable meshing tailored for a comfortable fit.

As depicted in FIG. 5A, an adjustment device 128 is centrally and operably attached to the rear portion 112*a*, configured to selectively and simultaneously adjust the length of the first and second side upper straps 114, 116 between the rear portion 112 and the front side 104 of the helmet shell 102 and simultaneously adjust the length of the first and second side lower straps 118, 120 between the rear portion 112 and the chin 12 of the user.

The adjustment device 128 may be a variety of devices capable of adjusting the length of each strap. For example, a cord, wire, lacing or belt system may be utilized in which a length of each strap may be adjusted by winding and unwinding, retracting, or otherwise altering the free length thereof.

Generally, the adjustment of the length of each strap between two points means the distance between the two points is adjusted either by increasing or decreasing the length thereof. For example, straps between the rear portion 112 and the front 104 of the helmet shell 102 of the retention system 100 may be selectively adjusted to increase or decrease the distance therebetween. Further, any one or more straps of the present application may comprise one or a plurality of strap segments or other components.

In certain versions as best shown in FIG. 5A-FIG. 5D, each of the first and second side upper straps 114, 116 and lower straps 118, 120 comprises an upper strap segment 130 and a movable member 132, such as, for example, a wire, lace portion or belt movably attached to the strap segment 130. Generally, the movable member 132 is configured to be movable relative to the helmet shell 102.

In particular, with reference to FIG. 5A, each of the movable members 132L, 132R of the upper straps 114, 116 extends from the rear portion 112, through an attachment portion 134 of each respective upper strap segment 130L, 130R, and reversing course extending back to the rear portion 112. The upper strap segments 130L, 130R extend forward from each respective movable member 132L, 132R toward the front 104 of the helmet shell 102.

Similarly, in the version, each of the first and second side lower straps 118, 120 comprises a lower strap segment 131L, 131R and a movable member 133L, 133R movably attached to the respective lower strap segments 131L, 131R. The movable members 133L, 133R extend from the rear portion 112, through an attachment portion 134 of the respective strap segment 131L, 131R, reversing course extending back to the rear portion 112. The lower strap segments 131L, 131R extend forward from the respective movable member 133L, 133R to the free ends 122, 124 near the chin 12 of the user. Ideally, in the illustrated version, the movable members 132, 133 are plastic or steel lacing or otherwise flexible line.

As best illustrated in FIG. 5A, the version of the retention system 100 further comprises a first side directional guide 136 and a second side directional guide 138, each for providing guidance and redirection of the collective movable members 132, 133 through a path of travel between the respective side upper strap 114, 116 to the lower strap 118, 120 respectively. Essentially, the directional guides 136, 138 are configured to receive, seat, and channel the collective movable members 132, 133 to and from the rear portion 112 of the retention system 100 throughout the path of travel between the respective upper strap and the lower strap.

In a certain version as shown in FIG. 5A, the first side upper strap 114 and the first side lower strap 118 share a unitary integral length of movable members (collectively movable members 132L, 133L) having a first end 140 and a second end 142. Ideally, the movable member is an elongated, flexible length of material such as a wire, cord, lacing or belt. Wherein the first end 140 of the movable member 132L, 133L is connected to a first side of the adjustment device 128. As an example, following the path of the movable member 132L, the movable member 132L extends laterally away from the rear portion 112 and the adjustment device 128 connecting to the first side upper strap 114 strap segment 130 by connecting at the attachment portion 134. The movable member 132L reverses course and extends back to the rear portion 112 to the first side directional guide 136. The first side directional guide 136 changes the course of the movable member 132L by redirecting it towards the first side lower strap 118 and forming a segment of the lower movable member 133L. Thus thereafter, the movable member 133L extends laterally away from the rear portion 112 connecting to the first side lower strap 118 strap segment 131L by looping through the attachment portion thereof 134. The movable member 133L reverses course yet again and extends back to the rear portion 112 terminating at the second end 142 fixedly connected to the rear portion 112.

In the illustrated version of FIG. 5A, in a mirrored configuration, the second side upper strap 116 and the second side lower strap 120 share a unitary integral length of movable member (collectively moveable members 132R, 133R) or lacing having a first end 144 and a second end 146. The first end 144 of the movable member 132R is connected to a second side of the adjustment device 128. Following the path of the movable member 132R, the movable member 132R extends laterally away from the rear portion 112 connecting to the second side upper strap 116 strap segment 130R by looping through the attachment portion 134. The movable member 132R reverses course and extends back to the rear portion 112 to the second side directional guide 138. The second side directional guide 138 changes the course of the movable member 132R by redirecting it towards the second side lower strap 120 and continuing as the moveable member 133R. Thus thereafter, the movable member 133R extends laterally away from the rear portion 112 connecting to the second side lower strap 120 strap segment 131R by looping through the attachment portion 134 thereof. The movable member 132R reverses course yet again and extends back to the rear portion 112 terminating at the second end 146 fixedly connected to the rear portion 112.

Figure 5B:
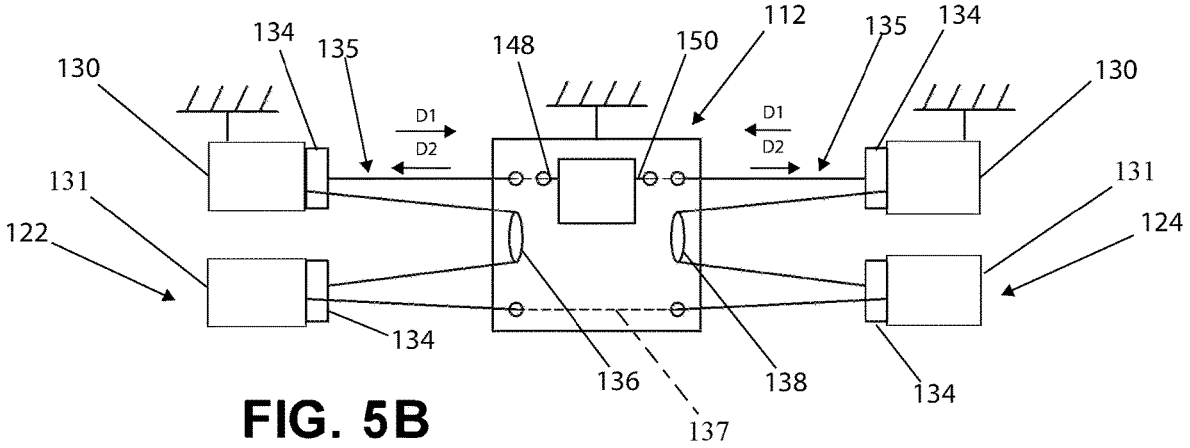
FIG. 5B is a schematic illustrating a helmet retention system in accordance with a second version of the present application.
Figure 5C:
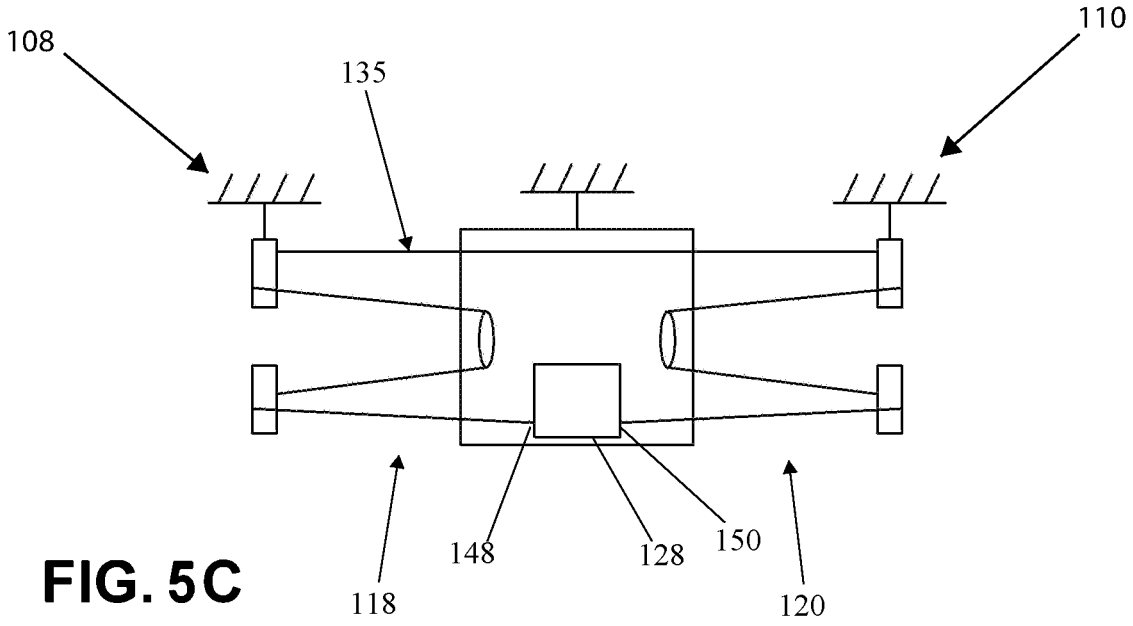
FIG. 5C is a schematic illustrating a helmet retention system in accordance with a third version of the present application.
Figure 5D:
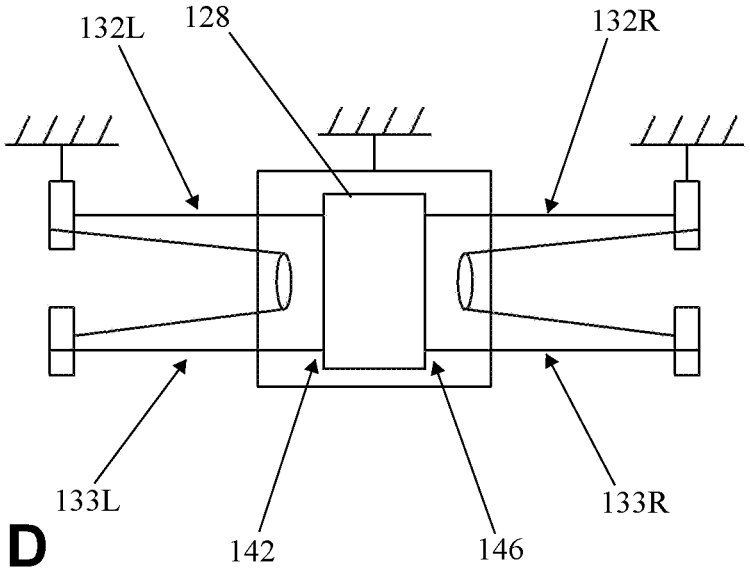
FIG. 5D is a schematic illustrating a helmet retention system in accordance with a fourth version of the present application.

Alternatively, as illustrated by FIG. 5D, the second ends 142, 146 of each side movable member 133L, 133R may operably terminate back to the adjustment device, wherein the adjustment device may be configured to manipulate both the first and second ends of each side of the collective unitary movable members 132R, 133R and 132R, 133R.

In other certain version as best illustrated by FIG. 5B and FIG. 5C, a unitary, integral length of lacing or movable member 135 having a first side adjustment end 148 and a second side adjustment end 150 is utilized. The movable member 135 operably connecting at each first side and second side adjustment ends 148, 150 to opposing sides of the adjustment device 128. For example, as illustrated in FIG. 5B, the movable member 135 extends continuously between the first side and the second side from the first side lower strap 118 strap segment 130 to the second side lower strap 120 strap segment 131 forming a unitary length of movable member 135 between the opposing sides and operably connected to the adjustment device at each adjustment side end 148, 150.

In further detail, as best shown in FIG. 5B, the version comprises a single, integral movable member 135 having first side adjustment end 148 and a second side adjustment end 150 as previously discussed. The first side adjustment end 148 and the second side adjustment ends 150 of the lacing 135 are operably connected to the BOA type adjustment device 128 at opposing sides. The adjustment device 128 can be rotated as designed to wind the movable member or lacing 135 therein, thereby altering and adjusting the free length of the lacing 135 or, oppositely, the tension can be released by disengaging the adjustment device 128. Different from the version shown in FIG. 5A, the moveable member 135 does not terminate at respective fixed ends 142, 146, but connects each of the first and right side portions of the moveable member 135 via a connecting segment 137. In the version, the connecting segment 137 of the moveable member 135 operably translates through the rear portion 112.

FIG. 5C illustrates a certain alternative version of the application, wherein the adjustment device 128 is positioned adjacent to the first and second side lower straps 118, 120 and configured to operably connect with first and second side adjustment ends 148, 150 of the movable member 135 extending from opposing first and second side lower straps 118, 120.

Referring to FIG. 5A-FIG. 5D, generally, the adjustment device 128 is configured to adjust one or more ends of the movable member 132, 133, 135 by selectively altering the free lengths thereof in a simultaneous manner. The adjustment device 128 may be any device capable of adjusting the length of the straps by imparting movement to the movable member. Ideally, a BOA type device (See www.boatechnology.com) can be utilized which adjusts the length of the elongated flexible member by winding or unwinding, retracting or detracting the free length ends thereof.

Overall, the retention system 100 provides support between three anchor points, namely, the rear of the head, front of the head, and the chin of the user, providing a secure, yet comfortable fit which is simple to actuate via a BOA type adjustment device 128.

When the adjustment device 128 is operated to retract each first and second side adjustment ends 148, 150 of the movable member 135 into the adjustment device 128, the movable member 135 is moved in a first direction D1 through each attachment portion 134 of each strap segment simultaneously. Thus, each strap segment 130, 131 is drawn toward the rear portion 112, thereby decreasing the length of each corresponding strap 114, 116, 118, and 120 in a concurrent manner to a degree necessary to adapt to the specific user's head size, thereby securing the helmet shell 102 to the head 10 of the user.

In further detail, each upper strap 114, 116 strap segment 130 is attached directly or indirectly at the left front temple portion 108 and the right front temple portion 110 of the helmet shell 102. Thus, when the movable member 132 is retracted into the adjustment device 128, the front 104 of the helmet shell 102 and at least a portion of the strap segments 130 are tightened against the side of the user's head 10 and the rear portion 112 is pulled in a direction forward against the rear of the user's head. Thus, providing a comfortable, yet secure fit about the user's head 10. In conjunction with the movement of the upper straps 114, 116, in a similar manner, the lower straps 118, 120 are tightened between the rear portion 112 and the chin portion 126 anchored by the user's chin, thus further securing the helmet shell 102 in conjunction with the user's chin 12.

When the adjustment device 128 is operated to release the movable member 135 permitting the movable member 135 to be pulled out of the adjustment device 128, the movable member 135 is moved in a second direction D2 through each attachment portion 134 of each strap segment 130 concurrently. Further, the strap segments 130, 131 of each strap 114, 116, 118, and 120 are permitted to move away from the rear portion 112 lengthening each strap. Therefore, each strap 114, 116, 118, and 120 and the rear portion 112 of the retention system 100 are loosened to facilitate removal of the helmet shell 102 from the user's head 10.

Now referring to FIG. 6A-FIG. 17, a version of the retention system demonstrating some of the above disclosed principles of the first version 100 will now be discussed in detail and is in generally designated by numeral 200. FIG. 6A-FIG. 9 show the retention system 200 removed from the helmet shell 102 and FIG. 10-FIG. 17 show the retention system operably coupled with the helmet shell 102. The retention system 200 is operably connected to the helmet shell 102 and is configured to hold and stabilize the helmet shell 102 on the user's head 10 (See FIG. 13). As shown, the retention system 200 generally comprises a chin portion 226, a rear portion 212, a plurality of straps and an adjustment device 228 for adjusting the length of selected strap.

Figure 6A:
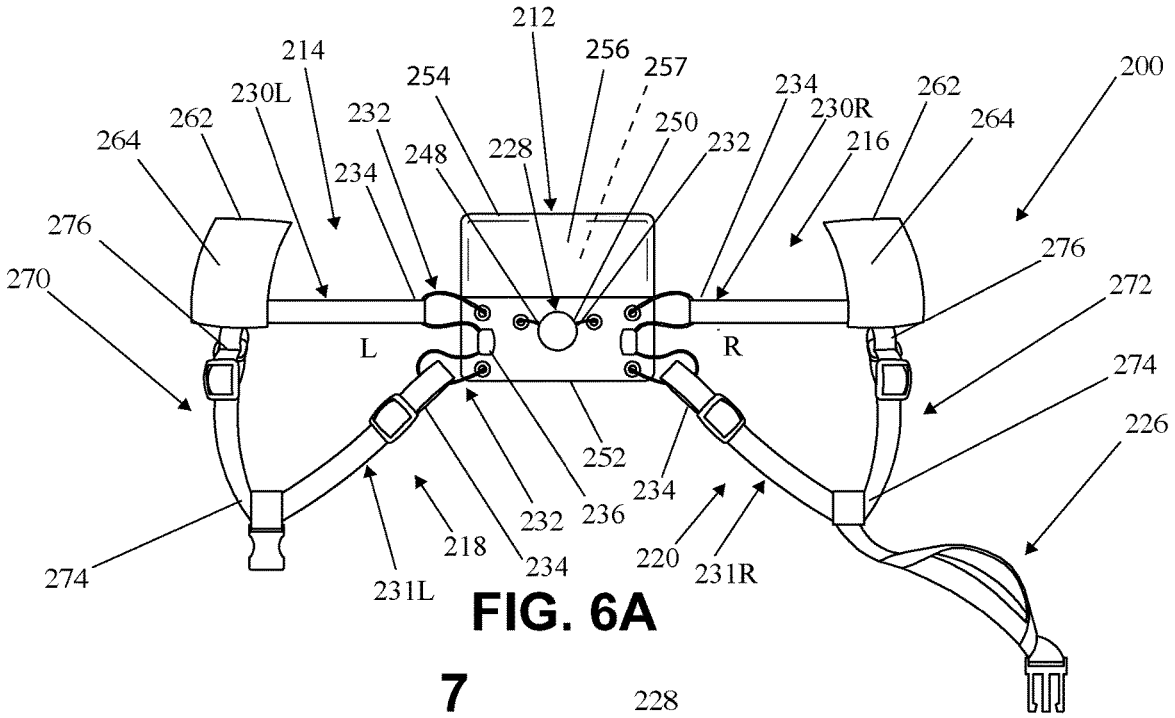
FIG. 6A is a top plan view of a version of the retention system removed from the helmet shell.
Figure 12:
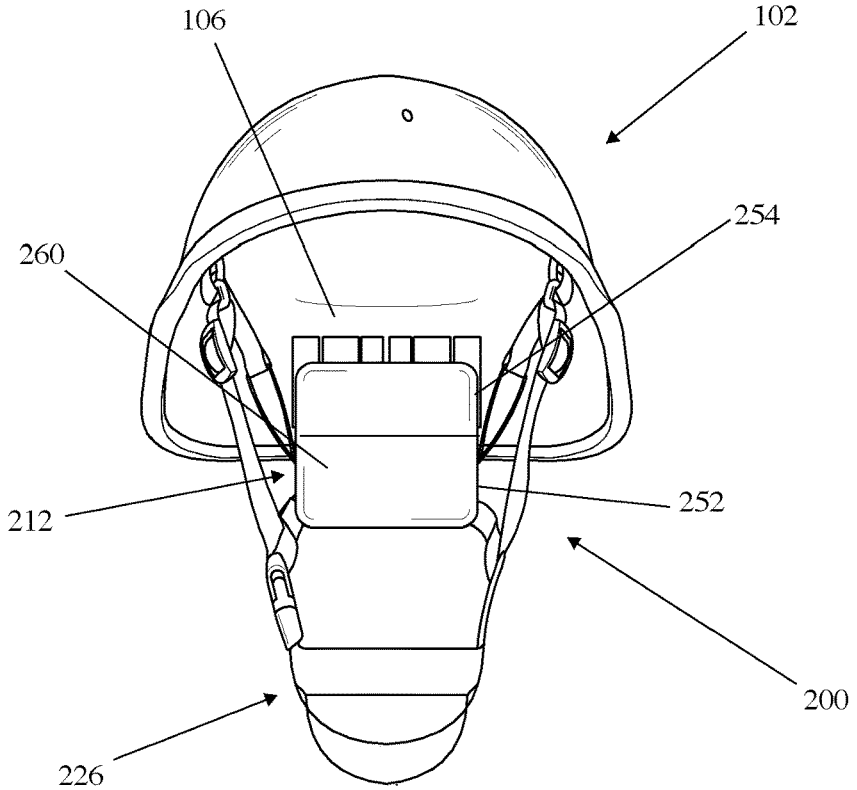
FIG. 12 is a front elevation view of the helmet and retention system of the version shown in FIG. 6A.

The chin portion 226 of the retention system 200 is configured to receive the chin 12 of the user and acts as a first anchor point of the retention system 200. As best illustrated by FIG. 6A and FIG. 12, the chin portion 226 comprises a plurality of flexible straps that are sewn together and are sized and configured to receive the user's chin 12 (See also FIG. 16). However, the chin portion 226 may be configured in a variety of other ways such as a chin cup made of one or more components or webbing material which embraces the chin 12 of the user, providing an anchor point.

Figure 6B:
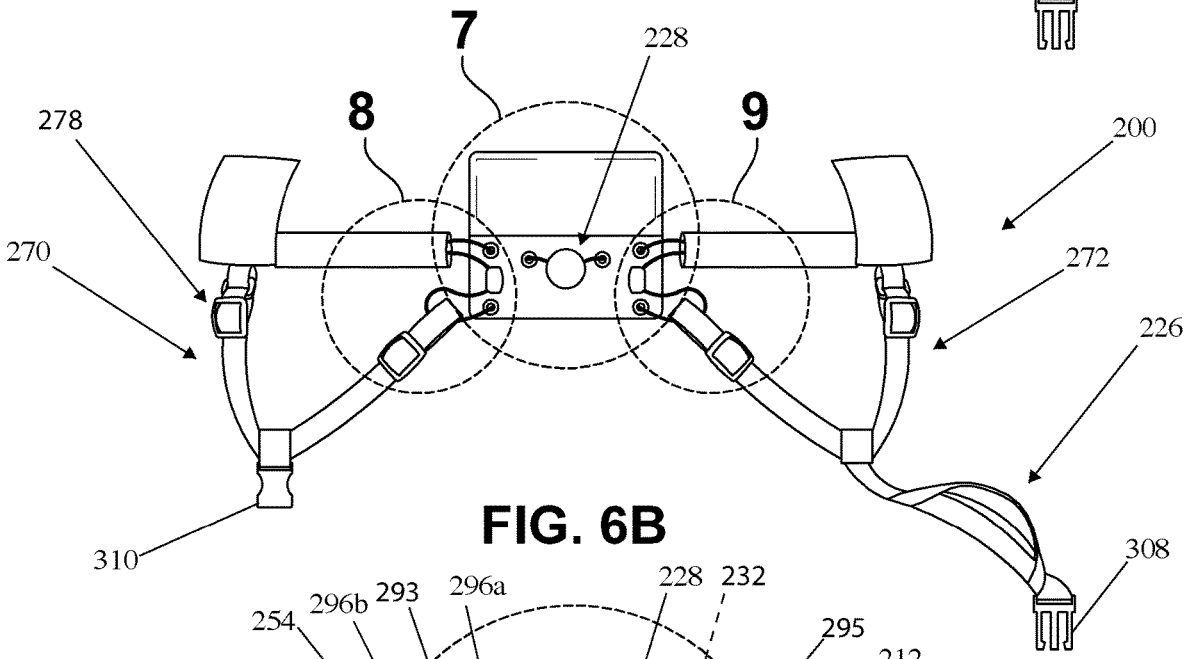
FIG. 6B is a top plan view of the version shown in FIG. 6A shown with upper strap covers.
Figure 14:
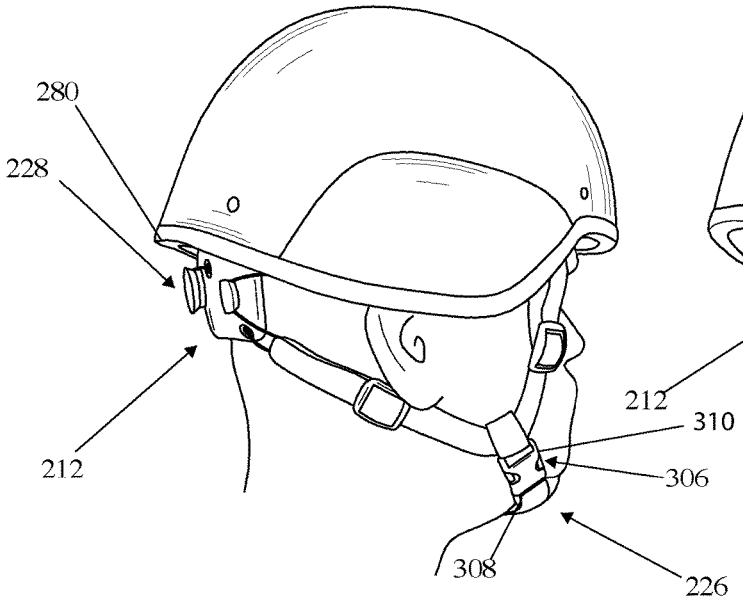
FIG. 14 is a right side perspective view of the version of the helmet and retentions system of the version shown in FIG. 6A.
Figure 15:
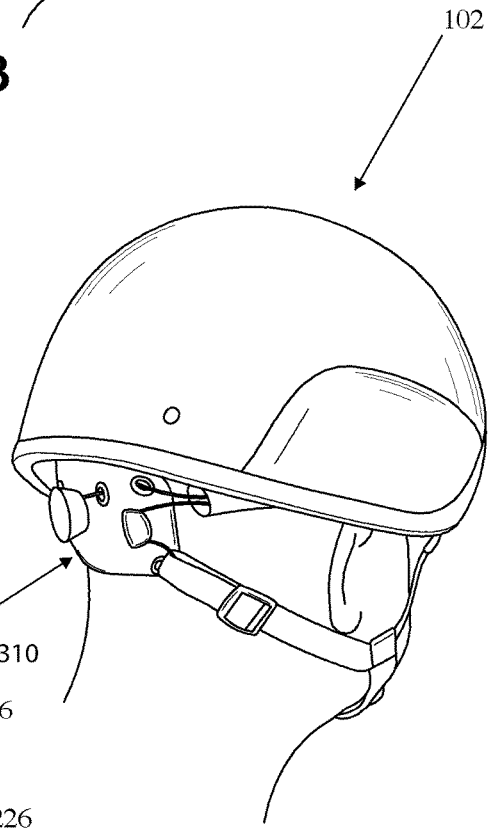
FIG. 15 is a right side perspective view of the version of the helmet and retention system of the version shown in FIG. 6A.
Figure 16:
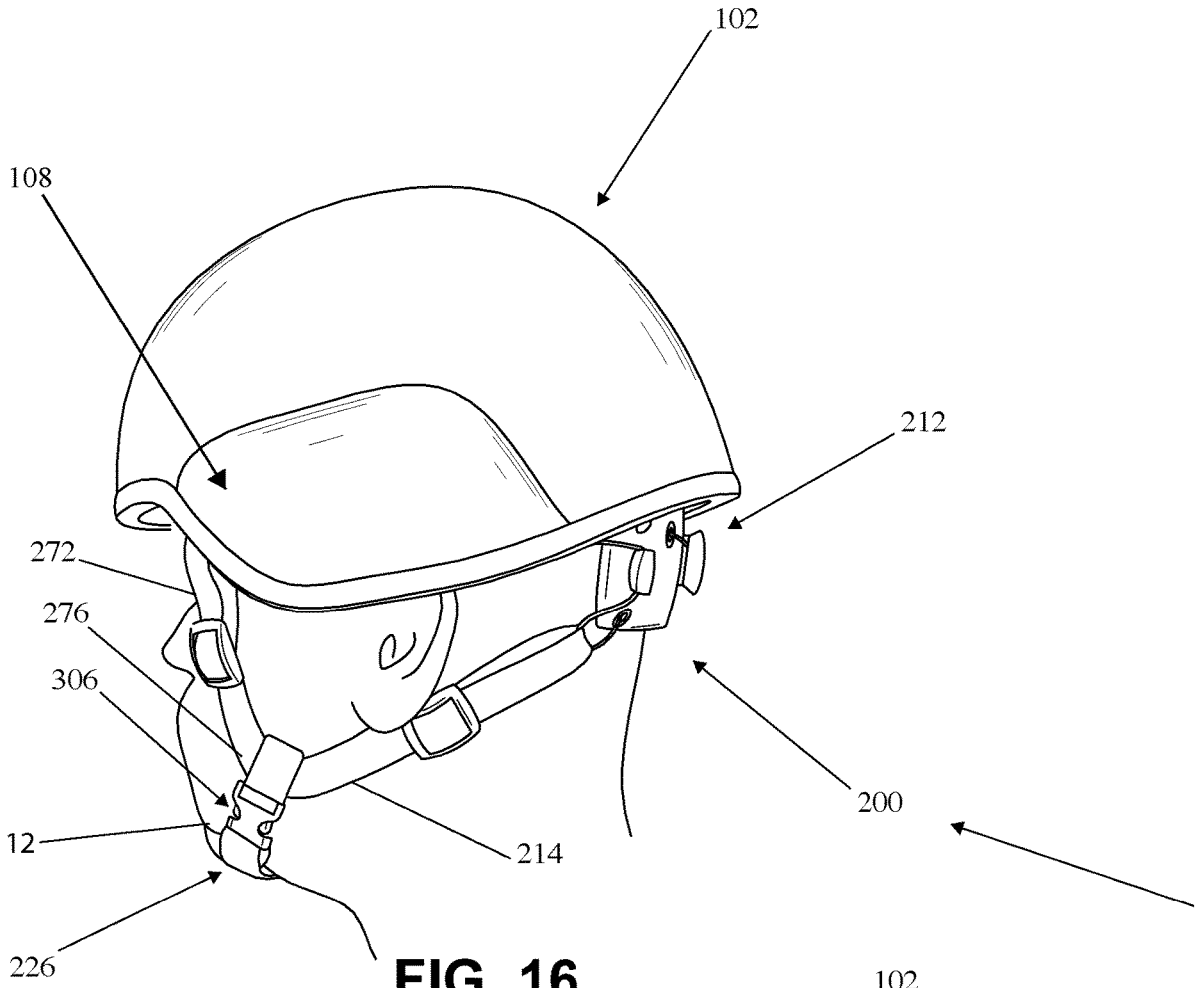
FIG. 16 is a left side perspective view of the version of the helmet and retention system of the version shown in FIG. 6A.

As illustrated in FIG. 6B and FIG. 14, the retention system 200 comprises a buckle 306 to permit removal of the retention system 200 and the helmet shell 102 from the head 10 of the user. As illustrated, a first portion 308 of the buckle 306 is attached to the chin portion 226 of the retention system 200 and a second portion 310 of the buckle 306 is attached to the left side lower strap 118 and the left side forward strap 272 lower end 274. Thus, release of the buckle 306 permits the chin portion 226 to be disconnected from the left lower strap 218 and left side forward strap 270 such that the user can remove the helmet shell 102.

The rear portion 212 of the retention system 200 is configured to contact the rear 16 of the user's head 10 and operates as a second anchor point of the retention system 200. As shown in FIG. 6A, a top plan view of the retention system 200 removed from the helmet shell 102, the rear portion 212 comprises a rectangular support structure 252 which is operably attached to the interior rear side 106 of the helmet shell 102. The rectangular support structure 252 is configured to provide a support structure for the adjustment device 228 and other guide mechanics of the retention system 200 as further detailed below.

In the version, the support structure 252 attaches to the interior of the rear side 106 of the helmet shell 102 by an upward extending attachment tab 254 comprising an external connection surface 256 and an internal connection surface 257, each having a hook and loop type fastener otherwise known as Velcro. The attachment tab 254 configured to operably attach with the interior side 106 of the helmet shell 102 having one or more reciprocal connection surfaces 258 comprised of hook and loop type fastener (See FIG. 6). In detail, FIG. 11 and FIG. 12 show coupling of the attachment tab 254 of the rear portion 212 with the reciprocal connection surfaces 258 of the rear side 106 of the helmet shell 102.

Preferably, the rear portion 212 and support structure 252 extend below the rear edge 280 of the rear 106 helmet shell 102 such that it is exposed and accessible to the user when wearing the helmet shell 102. The rear portion 212 and the support structure 252 may be a variety of shapes and sizes. Ideally as illustrated, a rectangular configuration is provided which extends substantially the width of the user's neck. Ideally, a portion of the support structure 252 is made of a padded material 260 which is positioned interior and adjacent to the user's head 10 such as a foam layer with a canvas exterior covering and an interior mesh, breathable covering. However, in certain embodiments, the rear portion may or may not be padded and may include one or more pieces of fabric or other material.

As best illustrated by FIG. 6A, the retention system 200 comprises a left side upper strap 214 and a right side upper strap 216. The left side upper strap 214 connects the rear portion 212 with the left front temple portion 108 of the helmet shell 102 and right side upper strap 216 connects the rear portion 212 with the respective right front temple portion 110 of the helmet shell 102. The opposing left front and right front temple portions 108, 110 of the helmet shell 102 forming connection points between of the retention system 200 near the front 104 of the helmet shell 102. The length of each of the left and right side upper straps 214, 216 between the rear portion 212 and the left front and right front temple portions 108, 110 is selectively adjustable to fit and stabilize the retention system around the circumference of the user's head 10.

Figure 10:
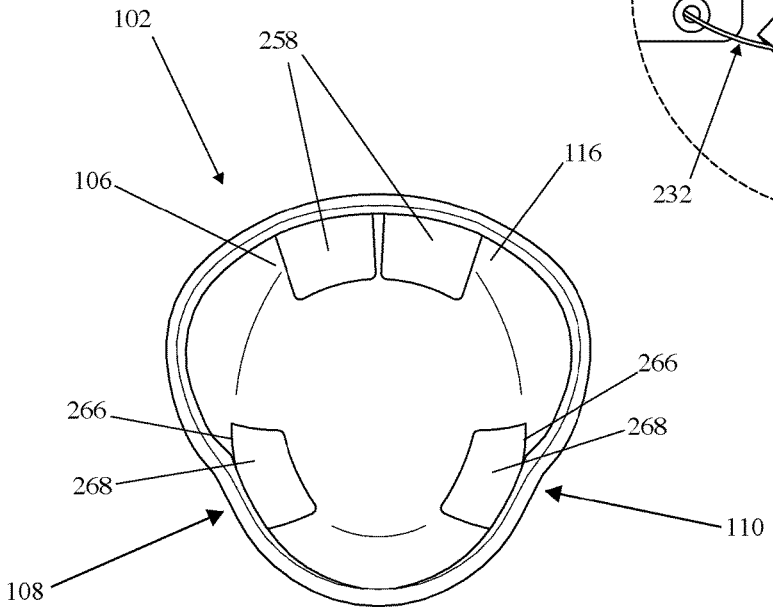
FIG. 10 is a bottom plan view of the helmet with the retention system removed of the version shown in FIG. 6A.
Figure 11:
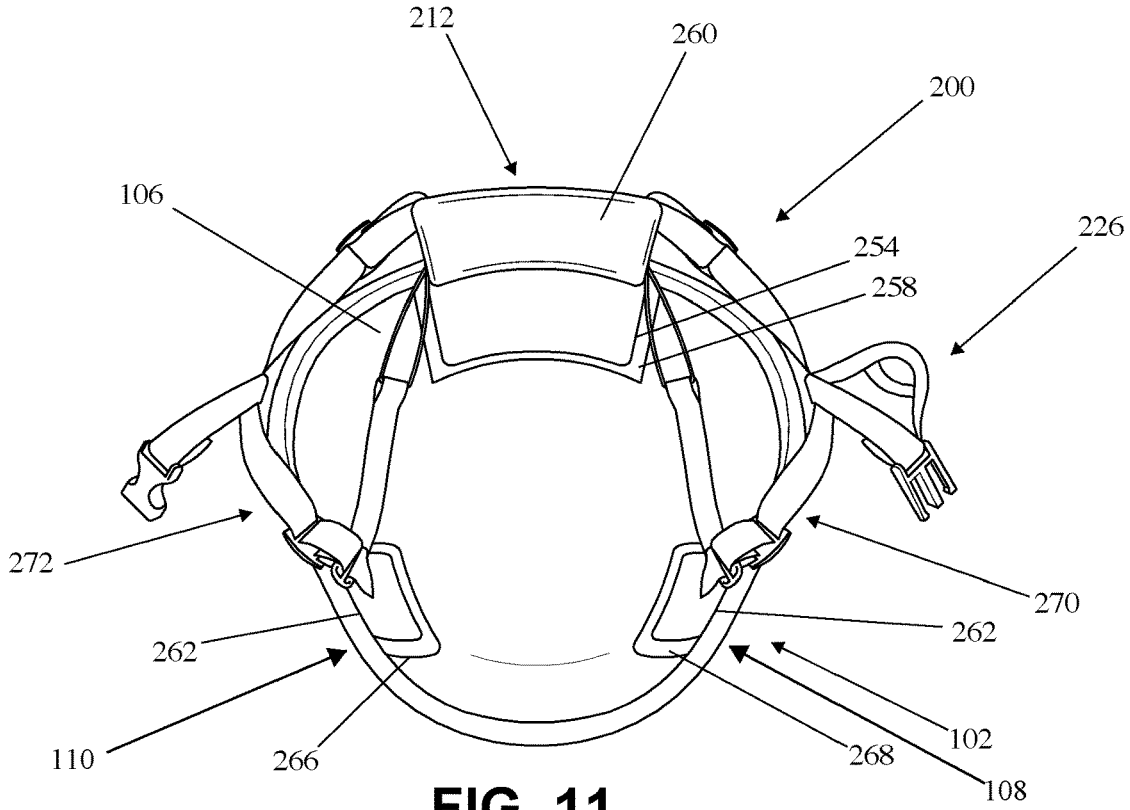
FIG. 11 is a bottom plan view of the helmet and the retention system of the version shown in FIG. 6A.

As shown in FIG. 6A, FIG. 10, and FIG. 11, each of the first and second side upper straps 214, 216 connect to the respective left front and right front temple portion 108, 110 via a connection means 262. In the version, the connection means is a connection tab 262 having a hook and loop type fastening surface 264 otherwise known as Velcro which is operably configured to couple with the helmet shell 102 left front and right front temple portions 108, 110 attachment portions 266 having a reciprocal hook and loop type fastener surfaces 268. Thus, providing a tight, secure fit to the interior temples of the helmet shell 102 while secured to the user's head 10. Other certain versions may utilize a connection means that sufficiently secures the strap directly or indirectly to the temple portions such as a hook, bolt, snap, or other fastener.

The retention system 200 further comprises a left side lower strap and a right side lower strap. The left side and right side lower straps 218, 220 connect the rear portion 212 with the chin portion 226. The length of each of the lower straps 218, 220 between the rear portion 212 and the chin portion 226 is selectively adjustable.

Further, the retention system 200 further comprises a left side forward strap 270 and a right side forward strap 272, each having a lower end 274 an upper end 276. The left side and right side forward straps 270, 272 generally connect the chin portion 226 with the respective left front and right front temple portions 108, 110 of the helmet shell 102 via the respective connection means 262. In certain versions, the forward left and right side straps 270, 272 lower ends 274 may be directly or indirectly attached to the chin portion 226 and/or the requisite left side and right side lower straps 218, 220. Similarly, the upper ends 276 may be directly or indirectly attached to the chin portion 226 and/or the requisite left side and right side upper straps 214, 216. The length of each of the left and right side forward straps 270, 272 between the chin portion 226 and the respective left front and right front temple portions 108, 110 may be selectively adjustable by way of a slidable buckle 278 or other adjustment device such as a slide, clasp, hook and loop fastener, and/or by way of an elastic band. Further, in other versions, the left and right side forward straps 270, 272 may not be adjustable and/or may be made of an elastic material in order to provide lengthening.

The upper, lower and forward straps may be attached to the helmet shell 102 in a variety of ways. For example, in certain versions, one or more of the straps are attached to a loop or other securing member that is attached to the helmet shell 102 with a fastener, such as a bolt or other fastening device. As illustrated and described above, the left side and right side upper straps 214, 216 and forward straps 270, 272 are connected near the front left and right temple portions 208, 210 via a hook and loop type fastener. Furthermore, any one or more of the straps may be directly or indirectly attached to a helmet liner of the helmet shell 102.

The attachment of any one or more of the straps to the helmet shell 102 may also be adjustable. For example, the loop or other securing member attaching the strap to the helmet shell may be configured such that the distance from the strap attachment point to the helmet shell 102 attachment point is adjustable.

An adjustment device 228 is used to selectively and simultaneously adjust the length of the left and right side upper straps 214, 216 and the left and right side lower straps 218, 220 between the rear portion 212 and the front 104 of the helmet shell 102 and the rear portion 212 and the chin portion 226 respectively. In certain embodiments, the adjustment device 228 is attached to the rear portion 212 and below the rear edge 280 of the helmet shell 102 such that it is exposed and accessible to the user when wearing the helmet (See FIG. 14-FIG. 17). Examples of adjustment devices 228 that may be used include a wire, lacing, or belt system in which a flexible material may be adjusted by winding and unwinding, retracting, or otherwise altering the free length thereof.

In the illustrated version, the adjustment device 228 comprises a wire or lacing device 228 attached to the rear portion 212 below the rear edge 280 of the helmet shell 102. As illustrated, the lacing device 228 is a Boa type lacing system. As described in more detail below, the lacing 232 weave pattern and the lacing device 228 is generally used to selectively adjust the length of the left and right side upper straps 214, 216 and the lower straps 218, 220 between the rear portion 212 and the front 104 of the helmet shell 102 and the rear portion 212 and the chin portion 226 in a simultaneous manner. The lacing 232 may be made of a variety of materials or combination of materials, including steel, plastic, or fabric. Ideally, the lacing is manufactured from a strong, resilient type steel.

As best shown in FIG. 6A-FIG. 9, each of the upper left and right side straps 214, 216 and the lower left and right side straps 218, 220 comprises a strap segment 230 and a lacing segment 232 movably attached to the strap segment 230. Generally, the lacing segment 232 is configured to be movable relative to the helmet shell 102. In the version as best illustrated by FIG. 6A the lacing segment 232 extends from the rear portion 212, through an attachment portion 234 of the strap segment 230 and extends back to the rear portion 212. Each strap segment 230 of the upper straps 214, 216 extend forward from the lacing segment 232 toward the front 104 of the helmet shell 102 and the respective temple portions 108, 110. Similarly, each of the first and second side lower straps 218, 220 comprises a strap segment 230 and lacing segment 232 movably attached to the strap segment 230. The lacing segment 232 extends from the rear portion 212, through an attachment portion 234 of the strap segment 230, reversing course extending back towards the rear portion 212. The strap segment 230 of each lower strap 218, 220 extends forward from the lacing segment 232 to the chin portion 226.

Figure 7:
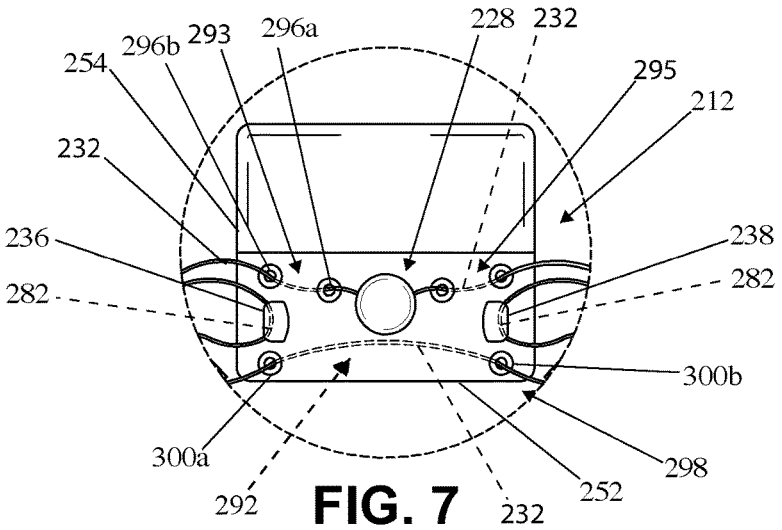
FIG. 7 is an up-close view of the rear portion taken from FIG. 6B.
Figure 8:
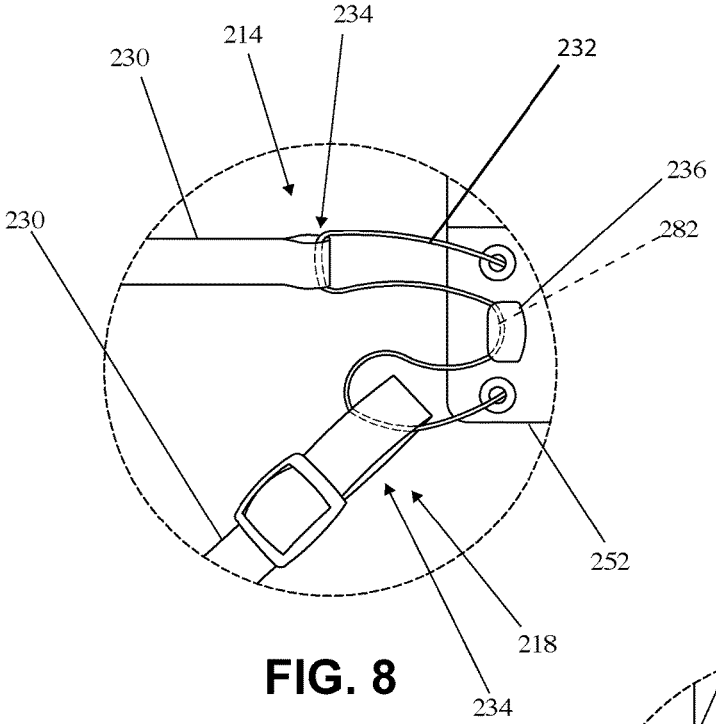
FIG. 8 is an up-close view of the left side portion of the retention system taken from FIG. 6B.
Figure 9:
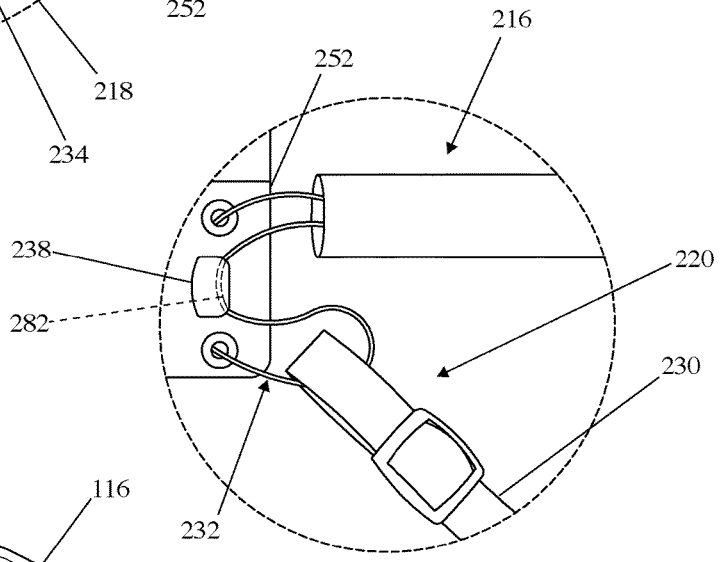
FIG. 9 is an up-close view of the right side portion of the retention system taken from FIG. 6B.

As best illustrated in FIG. 7-FIG. 9, the version of the retention system 200 further comprises a left side directional guide 236 and a right side directional guide 238, each for providing guidance and redirection of the lacing segments 232 through a path of travel between the upper strap 214, 216 to the lower strap 218, 220 respectively. Referring to the up-close views of FIG. 8 and FIG. 9, each directional guide 236, 238 ideally comprises a radial channel 282 operably configured to receive, seat, and channel the lacing segment 232 therein throughout the path of travel between the respective upper straps 214, 216 and the lower straps 218, 220 respectively.

In a certain version as shown in FIG. 6A, the lacing segments 232 collectively comprise a unitary integral lacing having a first side adjustment end 248 and a second side adjustment end 250. Wherein, the first side adjustment end 248 of the lacing 232 is connected to the left side of the adjustment device 228. Following the path of the lacing 232 commencing at the left side of the rear portion 212, the lacing 232 extends laterally away from the rear portion 212 and the adjustment device 228 connecting to the left side upper strap segment 230L by looping through the attachment portion 234 thereof. The lacing 232 returns by reversing course and extends back to the rear portion 212 to the left side direction guide 236. The left side directional guide 236 alters the course of the lacing 232 by redirecting it towards the left side lower strap 218. Thereafter, the lacing 232 extends laterally away from the rear portion 212 connecting to the left side lower strap segment 231 by looping through the attachment portion 234 thereof. The lacing 232 reverses course yet again and extends back to the rear portion 212 interconnecting with the right side path of the lacing 232.

In a mirrored configuration and referring to the right side of the rear portion supporting the right side path of the lacing 232, the right side adjustment end 250 of the lacing 232 is connected to the right side of the adjustment device 228. Following the path of the lace 232, the lace 232 extends laterally away from the rear portion 212 connecting to the right side upper strap segment 230R by looping through the attachment portion 234 thereof. The lacing 232 reverses course and extends back to the rear portion 212 to the right side direction guide 238. The right side directional guide 238 alters the directional course of the lacing 232 by redirecting it towards the right side lower strap 220. Thus thereafter, the lacing 232 extends laterally away from the rear portion 212 connecting to the right side lower strap segment 231R by looping through the attachment portion 234 thereof. The lacing 232 reverses course yet again and extends back to the rear portion 212 and integrally connects with the opposing side lacing 232 laterally through the rear portion 212.

In other versions, the lacing member may comprise a plurality of lacing segments which are either interconnected or dependent or a combination thereof. For example, each side having an upper and lower strap segment may utilize an independent unitary lacing segment which terminates at a fixed anchor point or is configured to operably connect at each end to the adjustment device and/or rear portion.

Referring to FIG. 7, generally, the adjustment device 228 is configured to adjust one or more ends of the flexible movable member or lacing 232 by selectively altering the free lengths thereof in a simultaneous manner. The adjustment device 228 may be any device capable of adjusting the length of the straps by imparting movement to the flexible movable member or lacing 232. Ideally, a BOA type device (See www.boatechnology.com) can be utilized which adjusts the length of the lacing segments 232 by winding or unwinding, retracting or detracting the free length ends thereof. In the illustrated version, the first side and second side adjustment ends 248, 250 of the lacing 232 are operably connected to the BOA type adjustment device 228 at opposing sides. The adjustment device 228 can be rotated as designed to wind the lace 232 therein, thereby altering and adjusting the free length of the lacing 232 or, oppositely, the tension can be released by disengaging the adjustment device 228.

Overall, the retention system 200 provides support between three anchor points, namely, at the rear 16 of the head 10 via the rear portion 212, front 104 of the head 10 via the left and right front temple portions 108, 110 of the helmet, and the chin 12 of the user via the chin portion 226, providing a secure, yet comfortable fit which is simple to actuate via a BOA type adjustment device 228.

When the adjustment device 228 is operated to retract each first and second side adjustment end 248, 250 of the lacing 232 into the adjustment device 228, the lacing 232 is moved in a first direction through each attachment portion 234 of each strap segment 230 simultaneously. Thus, each strap segment 230 is drawn toward the rear portion 212, thereby decreasing the overall length of each corresponding strap 214, 216, 218, and 220 in a concurrent manner to a degree necessary to adapt to the specific user's head 10 size, thereby securing the helmet shell 102 to the head 10 of the user.

In further detail, each upper strap 214, 216 strap segment 130 is attached directly or indirectly at the left front temple portion 208 and the right front temple portion 210 of the helmet shell 102. Thus, when the lacing 232 is retracted into the adjustment device 228, the front 104 of the helmet shell 102 and at least a portion of the strap segments 130 are tightened against the side of the user's head 10 and the rear portion 212 is pulled in a direction forward against the rear side of the user's head 10. Thus, providing a comfortable, yet secure fit about the user's head 10. In conjunction with the movement of the upper straps 214, 216, in a similar manner, the lower straps 218, 220 are tightened between the rear portion 212 and the chin portion 226 anchored by the user's chin 12, thus further securing the helmet shell 102 in conjunction with the user's chin 12.

When the adjustment device 228 is operated to release the lacing 232 permitting the lacing 232 to be pulled out of the adjustment device 228, the lacing 232 is moved in a second direction through each attachment portion 234 of each strap segment 230 concurrently. Further, the strap segments 230 of each strap 214, 216, 218, and 220 are permitted to move away from the rear portion 212 lengthening each strap. Therefore, each strap 214, 216, 218, and 220 and the rear portion 212 of the retention system 200 are loosened to facilitate removal of the helmet shell 102 from the user's head 10.

In further detail, each upper strap segment 214, 216 is attached directly or indirectly at the right and/or left front or right front temple portions 208, 210 of the helmet shell 102. Thus, when the lacing 232 is retracted into the adjustment device 228, the front 104 of the helmet shell 102 and at least a portion of the strap segments 230 are tightened against the side of the user's head and the rear portion 212 is pulled in a direction forward against the rear side 106 of the user's head 10. Thus, providing a snug fit about the user's head 10 when the helmet shell 102 is secured. In conjunction with the movement of the upper right and left straps 214, 216, similarly, the lower straps 218, 220 are tightened between the rear portion 112 and the free ends of the lower straps 218, 120 securing the chin portion 226 to the chin 12 of the user, thus further securing the helmet shell 102 in conjunction with the user's chin 12.

Figure 17:
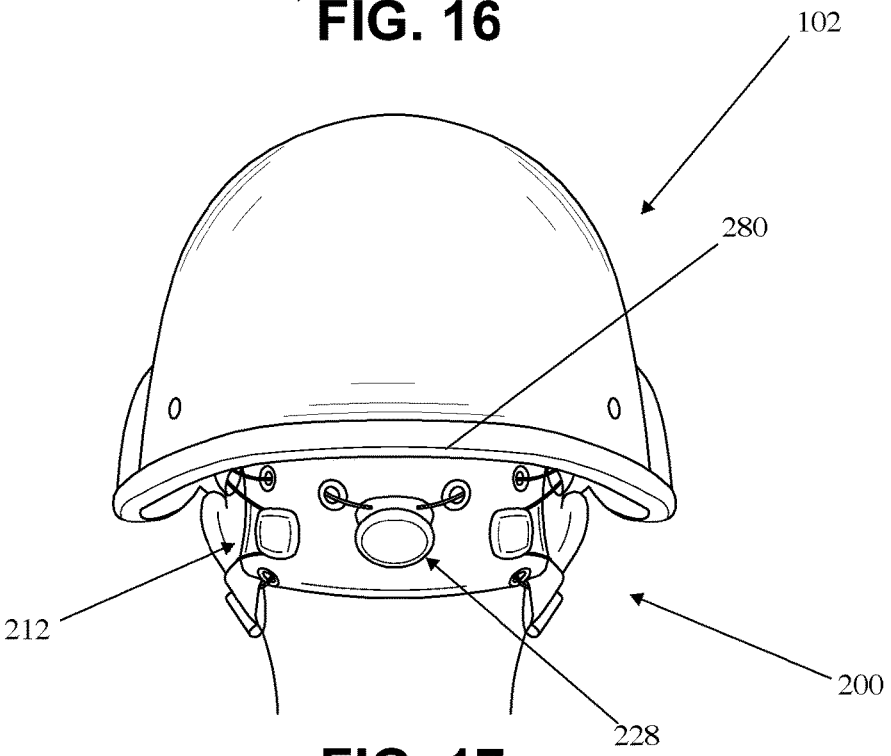
FIG. 17 is a rear elevation view of the version of the helmet and retention system as shown in FIG. 6A.

As best illustrated by FIG. 17, the rear portion of the retention system 200 is generally configured to contact the rear side of the user's head 10 and acts as an anchor point of the system. The rear portion 212 may or may not extend below the rear edge 280 of the helmet shell 102 such that it is exposed and accessible to the user when wearing the helmet. The rear portion 112 may also be a variety of shapes and sizes, for example, the rear portion 212 may be shaped as triangle, square, rectangle, circle, or any other shape. The rear portion 212 may comprise padding material such as foam with a with a canvas covering or a breathable meshing.

Now referring to FIG. 7, a certain version of the retention system 200 is illustrated. In the version, the rear portion 212 may comprise an inner layer 288 and an exterior layer 290 forming an inner compartment 292 therebetween. The exterior layer 290 has a first side and a second side upper lateral guides 293, 295 for providing directional guidance and limiting the vertical travel of the lacing 232 which extends from the adjustment device 228 to the respective first and second side upper strap 214, 216 strap segments 230. In detail as illustrated in FIG. 7, the first and second side upper lateral guides 293, 295 comprise at least two laterally positioned guide holes 296 which provide ingress and egress to the inner compartment 292. Thus, following the path of the lacing 232, the lace 232 extends away from the adjustment device 228 into a first guide hole 296*a* leading to the inner compartment 292 for a brief segment, then exiting through the second guide hold 296*b*, extending laterally away to the requisite strap segment 230. As such, the vertical movement of the lacing extending away from the adjustment device 228 is under control.

As illustrated in FIG. 7, the rear portion 212 may further comprise a lower lateral guide 298 for providing directional guidance and limiting the vertical travel of the lacing 232 extending between the first side lower strap 218 and the second side lower strap 220, traversing the rear portion 212. As best illustrated by FIG. 7, the lower lateral guide 298 comprises at least two laterally positioned holes 300 which provide ingress and egress to the inner compartment 292. Thus, following the path of the lacing 232 extending between the lower straps 218, 220, the lacing 232 extends into a first guide hole 300*a* near the first side perimeter 302 leading to the inner compartment 292 for a segment, then exiting through the second guide 300*b* hole near the second side perimeter 304, extending laterally away to the opposing lower strap segment 230.

FIG. 6B illustrates the use of one or more comfort pads in conjunction with the left and right side upper straps 214, 216. The comfort pads provide a barrier between the user's head 10 and the combination strap segment 230 and the lacing segment 232.

Figure 18:
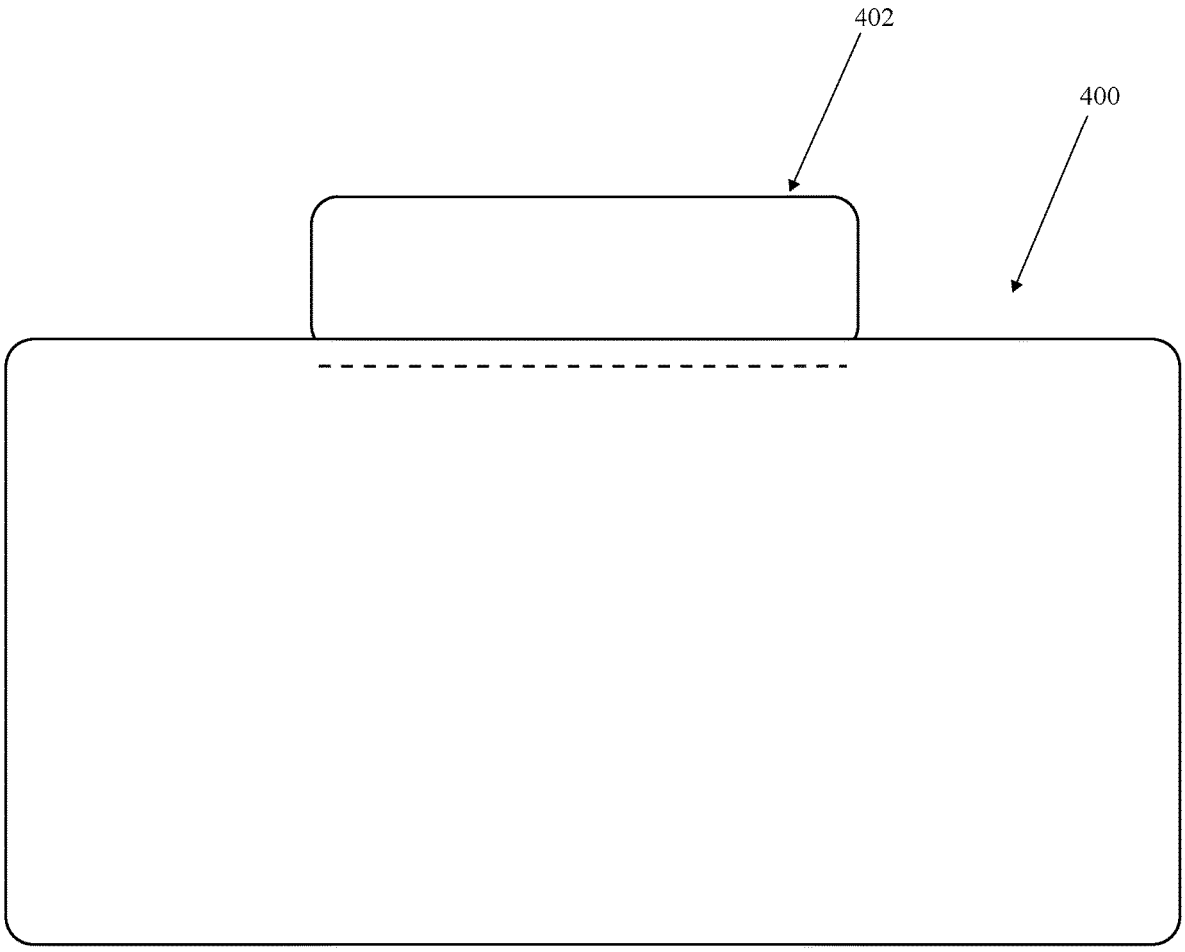
FIG. 18 is an elevation view of a supplemental nape pad.
Figure 19:
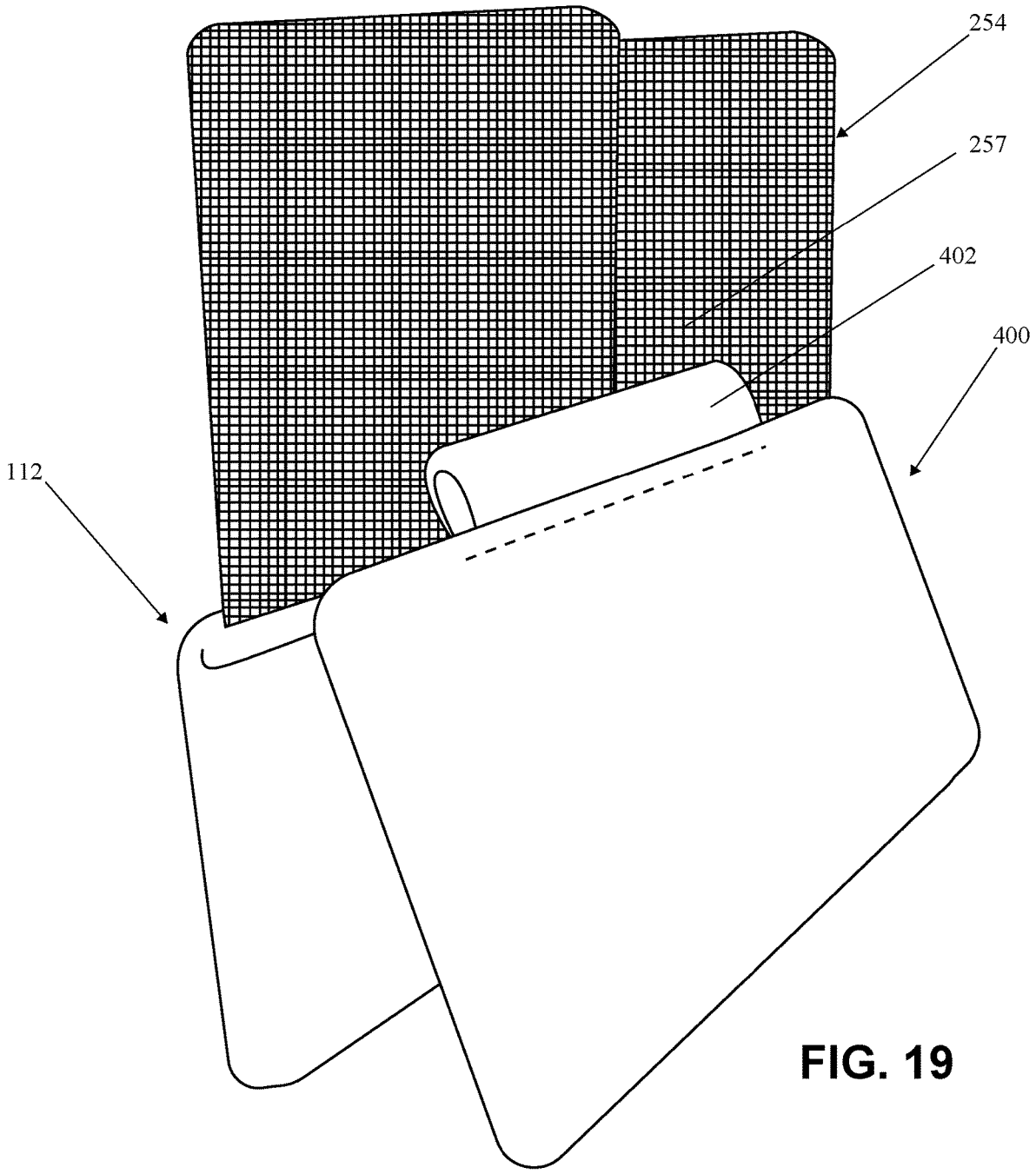
FIG. 19 is an interior side perspective view of the supplemental nape pad operably connected to the rear portion of the retention system.

Referring to FIG. 18-FIG. 19, a version of the application may further include a supplemental nape padding 400 positioned and aligned interior of the rear portion 112. The nape padding 400 is preferably designed to provide an additional padding depth for ensuring comfort while worn. Preferably, the supplemental nape padding 400 is manufactured of a padding material such as foam with a canvas covering or a breathable meshing tailored for a comfortable fit. The nape padding 400 is operably attached to the rear portion 112, for example, via a hook and loop connection tab 402 that operably connects to the internal connection surface 257 of the attachment tab 254 connecting the rear portion 112. Preferably, the nape padding 400 is sized and shaped similar to the size and shape of the rear portion 112 in order to effectively provide a barrier between the back user's neck and the rear portion 112.

Figure 20:
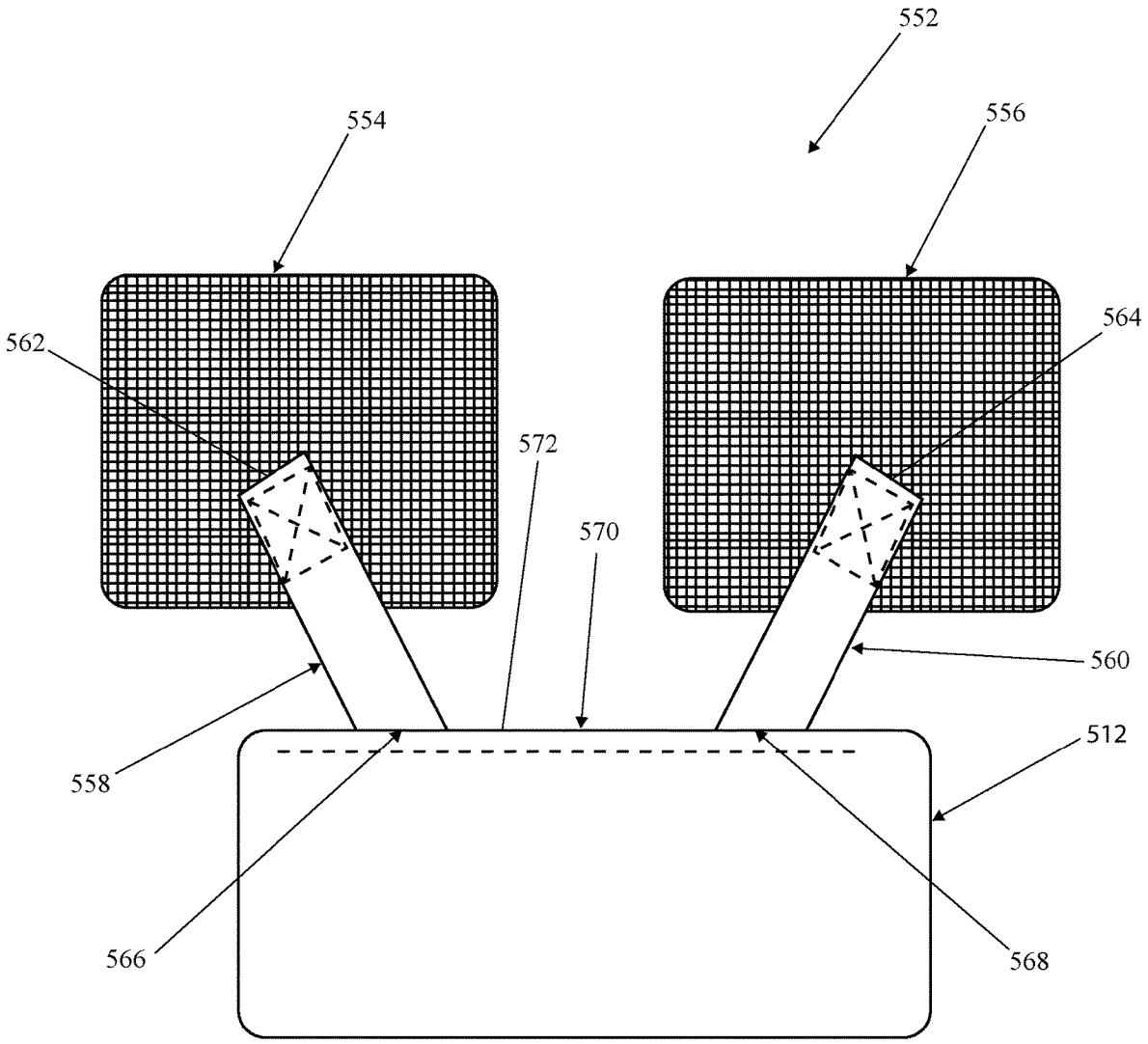
FIG. 20 is an interior side perspective view of an alternative version of the rear portion.
Figure 21:
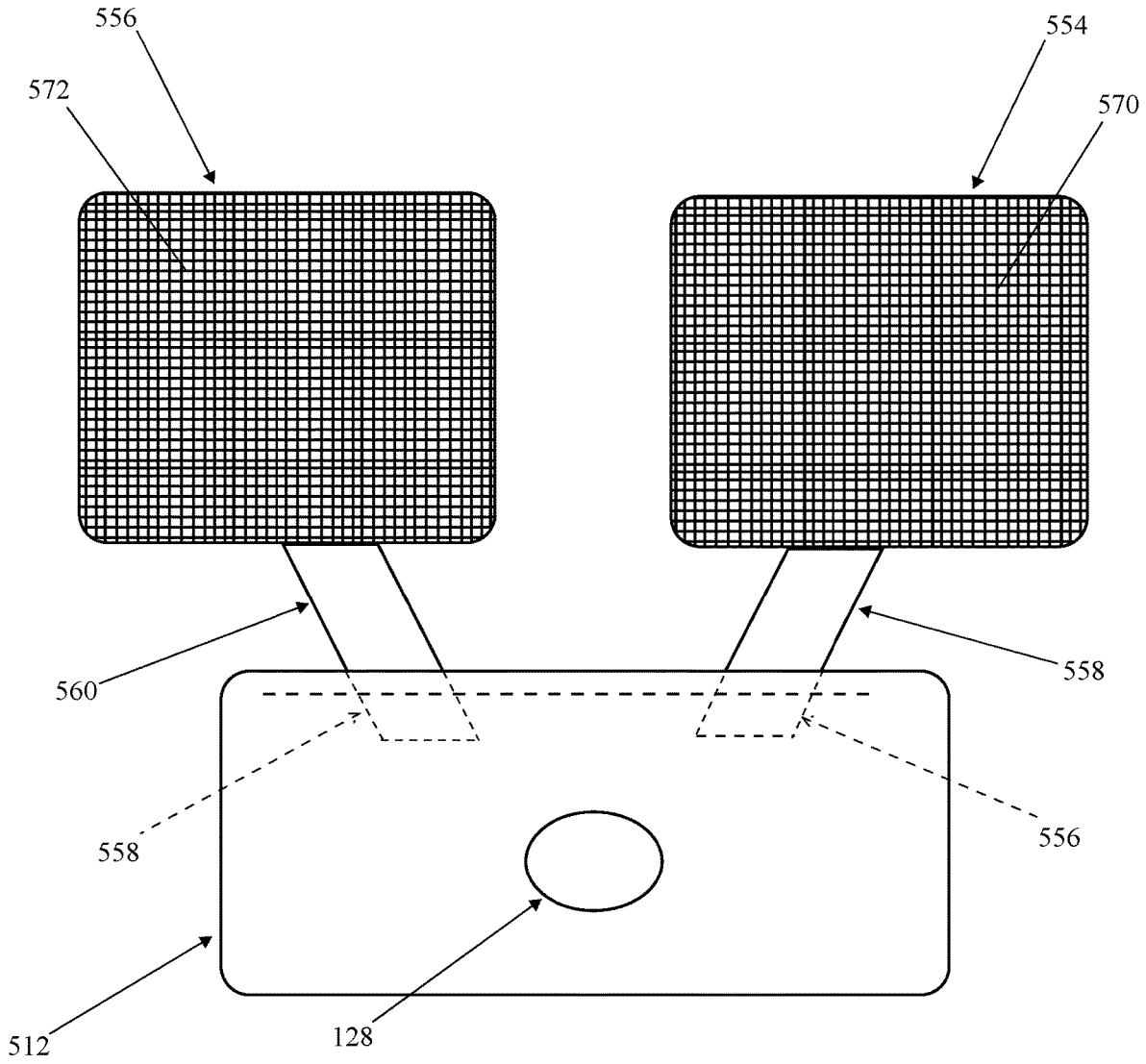
FIG. 21 is an exterior side perspective view of the rear portion as shown in FIG. 20.
Figure 22:
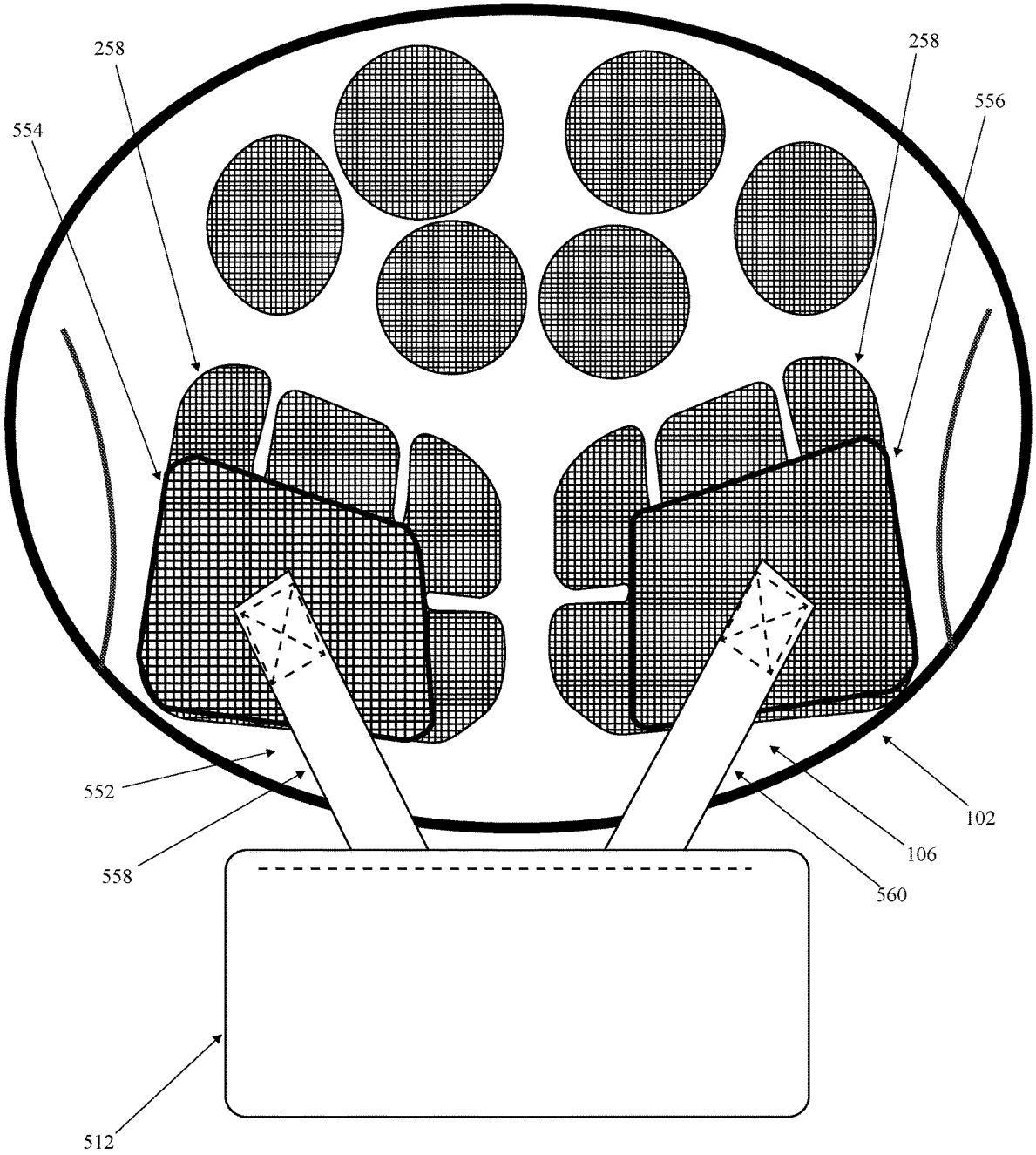
FIG. 22 is an interior perspective view of the rear portion shown in FIG. 20 while attached to the interior of a helmet shell.

With reference to FIG. 20-FIG. 22, in an alternative version, the rear portion 512 may be attached to the interior rear side 106 of the helmet shell 102 via a support structure 552 which equally divides tension between a first and second attachment tab 554, 556. Specifically, FIG. 20 is a rear elevation view of the rear portion 112 and the associated support structure 552. The rear portion 512 is attached to each respective first and second attachment tabs 554, 556 via respective first and second straps 558, 560. Each of the first and second straps 558, 560 have an upper end 562, 564 and a lower end 566, 568, wherein the upper ends 562, 564 are affixed centrally to the respective attachment tab 554, 556 and the lower ends 566, 568 are affixed offset of the center 570 of the upper perimeter 572 of the rear portion 512. As shown in FIG. 21, the lower ends 566, 568 of each of the first and second straps 558, 560 are embedded a length within the body of the rear portion 112 for reinforcement. The first and second straps 558, 560 having a mirrored orientation with respect to the other. Each of the first and second straps 558, 560 operably extend at an angle between the rear portion 512 and the respective attachment tab 554, 556, thereby positioning the lateral boundaries of each respective attachment tab 554, 556 beyond the lateral boundaries of the rear portion 112. Preferably, the angle formed between the longitudinal axis of each respective straps 558, 560 and the horizontal axis of the rear portion 512 is approximately between 30-60 degrees, preferably 45 degrees. The purpose of this configuration is provide improved lateral support to the rear portion 112 by broadening the footprint of the attachment points within the rear side 106 interior of the helmet shell 102 and by utilizing nylon straps having a higher tensile strength along the strap 558, 560 longitudinal axis.

Specifically, the first and second attachment tabs 554, 556 each include an external connection surface 570, 572 which operably adhere to the interior rear side 106 of the helmet shell 102, each external connection surface 570, 572 having a hook and loop type fastener otherwise known as Velcro. The first and second attachment tabs 554, 556 are operably configured to attach with the interior rear side 106 of the helmet shell 102 having one or more reciprocal connection surfaces 258 comprised of reciprocal hook and loop type fastener (See FIG. 22). In detail, FIG. 22 shows coupling of the attachment tabs 554, 556 of the rear portion with the reciprocal connection surfaces 258 of the rear side 106 of the helmet shell 102.

The invention does not require that all the advantageous features and all the advantages need to be incorporated into every version of the invention.

Although preferred embodiments of the invention have been described in considerable detail, other versions and embodiments of the invention are certainly possible. Therefore, the present invention should not be limited to the described embodiments herein.

All features disclosed in this specification including any claims, abstract, and drawings may be replaced by alternative features serving the same, equivalent or similar purpose unless expressly stated otherwise.

What is claimed is:

1. A helmet retention system for securing a helmet to a head of a user, the retention system attached to a helmet shell having a front, a rear, a first side and an opposing second side comprising:

a rear portion connected to the rear of the helmet;

a chin portion configured to receive a chin of the user;

a first side upper strap extending from the rear portion to the front of the helmet;

a second side upper strap extending from the rear portion to the front of the helmet;

a first side lower strap extending from the rear portion to the chin portion;

a second side lower strap extending from the rear portion to the chin portion; and an adjustment device operably attached to the rear portion configured to selectively and simultaneously adjust the length of the first side upper strap and the second side upper strap between the rear portion and the front of the helmet and simultaneously adjust the length of the first side lower strap and the second side lower strap between the rear portion and the chin portion;

wherein the first side upper strap and the second side upper strap each comprises a strap segment extending from the front of the helmet and an elongated flexible member movably attached to the strap segment and movable relative to the helmet shell;

wherein the first side lower strap and the second side lower strap each comprises a strap segment extending from the chin portion and an elongated flexible member movably attached to the strap segment and movable relative to the helmet shell;

wherein the elongated flexible members form a unitary length of material having a first and second end;

wherein the adjustment device is configured to selectively adjust at the first and second ends of the elongated flexible member to move each strap segment relative to the helmet shell and adjust the length of the first and second side upper straps between the rear of the helmet shell and the front of the helmet shell and adjust the length of the first and second side lower straps between the rear of the helmet shell and the chin portion.

2. The helmet retention system of claim 1, wherein the rear portion further comprises a first side directional guide and a second side directional guide for providing directional guidance of the elongated flexible member from the first side upper strap to the first side lower strap and from the second side upper strap to the second side lower strap respectively.

3. The helmet retention system of claim 2, wherein the elongated flexible member extends laterally from the adjustment device movably attaching to a free end of the first side upper strap segment, returning and movably attaching to the first side directional guide, extending laterally away from the rear portion movably attaching to a free end of the second side lower strap segment, extending back towards the rear portion, extending laterally across the rear portion and movably attaching with the second side lower strap segment, returning and movably attaching to the second side directional guide, extending laterally away from the rear portion and movably attaching to the second side upper strap segment, and returning back to the adjustment device.

4. The helmet retention system of claim 3, wherein the rear portion comprises an inner layer and an exterior layer forming an inner compartment, wherein the exterior layer comprises a first side and a second side upper lateral guides for providing directional guidance and limiting vertical travel of the elongated flexible member extending away from the adjustment device to the respective first and second side upper strap segments.

5. The helmet retention system of claim 4, wherein the first side and the second side upper lateral guides each comprise a plurality of laterally positioned guide holes providing ingress and egress to and from the inner compartment, wherein the elongated flexible member is woven from the adjustment device through a first guide hole leading to the inner compartment for a brief segment, then exiting through a second guide hole, then laterally to the respective first and second upper strap segments.

6. The helmet retention system of claim 5, wherein the exterior layer further comprises at least one lower side lateral guide for providing limiting vertical travel of the elongated flexible member extending between the first side lower strap segment to the second side lower strap segment.

7. The helmet retention system of claim 6, wherein the at least one lower side lateral guide comprises at least two laterally positioned guide holes providing ingress and egress to and from the inner compartment, wherein the elongated flexible member is woven from the first side lower strap segment through a first guide hole leading to the inner compartment for a brief segment, then exiting through a second guide hold, and extending to the second side lower strap segment.

8. The helmet retention system of claim 3, wherein the rear portion comprises an inner layer and an exterior layer forming an inner compartment, wherein the exterior layer comprises at least one lower side lateral guide for providing limiting vertical travel of the elongated flexible segment extending between the first side lower strap segment to the second side lower strap segment.

9. The helmet retention system of claim 8, wherein the at least one lower side lateral guide comprises at least two laterally positioned guide holes providing ingress and egress to and from the inner compartment, wherein the elongated flexible member is woven from the first side lower strap segment through a first guide hole leading to the inner compartment for a brief segment, then exiting through a second guide hold, and extending to the second side lower strap segment.

10. The helmet retention system of claim 1, wherein the adjustment device is a lacing device and the elongated flexible member is a lace.

11. The helmet retention system of claim 10, wherein each strap segment comprises an attachment portion that movably attaches the lace, wherein the lace is moved through the attachment portion and the strap segment is moved toward the rear portion when the lace is retracted into the lacing device.

12. The helmet retention system of claim 1, wherein the rear portion extends below a rear edge of the helmet shell such that it is exposed and accessible to the user when wearing the helmet.

13. The helmet retention system of claim 1, wherein at least a portion of the first side and second side upper straps and the first side and second side lower straps are tightened against the right and left sides of the user's head and the rear portion is pulled forward and upward against the rear of the user's head when the elongated flexible members of the side straps are retracted into the adjustment device.

14. The helmet retention system of claim 1, wherein the retention system further comprises a first and second opposing forward straps extending from the chin portion to the respective first and second side upper strap near the front of the helmet, wherein the length of each strap between the chin portion and the front of the helmet is selectively adjustable.

15. A helmet retention system for securing a helmet to a head of a user, the retention system attached to a helmet shell having a front, a rear, a first side and an opposing second side comprising:

a rear portion connected to the rear of the helmet;

a chin portion configured to receive a chin of the user;

a first side upper strap and a second side upper strap extending from the rear portion to the front of the helmet, wherein each strap comprises a strap segment extending from the front of the helmet and a movable member attached to the strap segment extending between the strap segment and the rear portion; and a first side and a second side lower strap extending from the rear portion to the chin portion; wherein each strap comprises a strap segment extending from the chin portion and a movable member attached to the strap segment extending between the strap segment and the rear portion;

wherein each movable member collectively forms a length of lace having a first and second end;

a lacing device operably attached to the rear portion configured to selectively and simultaneously adjust the length of the first and second side upper straps between the rear portion and the front of the helmet and simultaneously adjust the length of the first and second side lower straps between the rear portion and the chin portion; wherein the lacing device is configured to selectively retract and detract at the first and second ends of the length of lace to move each strap segment relative to the rear portion and adjust the length of the first and second side upper straps between the rear portion and the front of the helmet and adjust the length of the first and second side lower straps between the rear portion and the chin portion;

wherein the rear portion further comprises a first side directional guide and a second side directional guide for providing directional guidance of the length of lace from the first side upper strap to the first side lower strap and from the second side upper strap to the second side lower strap respectively; and wherein the length of lace extends laterally from the adjustment device movably attaching to a free end of the first side upper strap segment, returning and movably attaching to the first side directional guide, extending laterally away from the rear portion movably attaching to a second free end of the second side lower strap segment, extending back towards the rear portion, extending laterally across the rear portion and movably attaching with the second side lower strap segment, returning and movably attaching to the second side directional guide, extending laterally away from the rear portion and movably attaching to the second side upper strap segment, and returning back to the adjustment device.

16. The helmet retention system of claim 15, wherein the rear portion comprises an inner layer and an exterior layer forming an inner compartment therebetween, wherein the exterior layer comprises a first side and a second side upper lateral guides for providing directional guidance and limiting vertical travel of the length of lace extending away from the adjustment device to the respective first and second side upper strap segments.

17. The helmet retention system of claim 16, wherein the first side and the second side upper lateral guides each comprise a plurality of laterally positioned guide holes providing ingress and egress to and from the inner compartment, wherein the length of lace is woven from the adjustment device through a first guide hole leading to the inner compartment for a brief segment, then exiting through a second guide hole, then laterally to the respective first and second upper strap segments.

18. The helmet retention system of claim 17, wherein the exterior layer further comprises at least one lower side lateral guide for providing limiting vertical travel of the length of lace extending between the first side lower strap segment to the second side lower strap segment.

19. The helmet retention system of claim 18, wherein the at least one lower side lateral guide comprises at least two laterally positioned guide holes providing ingress and egress to and from the inner compartment, wherein the length of lace is woven from the first side lower strap segment through a first guide hole leading to the inner compartment for a brief segment, then exiting through a second guide hole, and extending to the second side lower strap segment.

20. A helmet retention system for securing a helmet to the head of a user, the retention system attached to a helmet shell having a front, a rear, a first side and an opposing second side comprising:

a rear portion connected to the rear of the helmet;

a chin portion configured to receive the chin of the user;

a first side upper strap and a second side upper strap extending from the rear portion to the front of the helmet, wherein each strap comprises a strap segment extending from the front of the helmet and a lace segment movably attached to the strap segment extending between the strap segment and the rear portion;

a first side and a second side lower strap extending from the rear portion to the chin portion; wherein each strap comprises a strap segment extending from the chin portion and a lace segment attached to the strap segment extending between the strap segment and the rear portion;

wherein each lace segment collectively forms a length of lace having a first and second end;

a lacing device operably attached to the rear portion configured to selectively and simultaneously adjust the length of the first and second side upper straps between the rear portion and the front of the helmet and simultaneously adjust the length of the first and second side lower straps between the rear portion and the chin portion; wherein the lacing device is configured to selectively retract and detract at the first and second ends of the lace to move each strap segment relative to the rear portion and adjust the length of the first and second side upper straps between the rear portion and the front of the helmet and adjust the length of the first and second side lower straps between the rear portion and the chin portion;

wherein the rear portion further comprises a first side directional guide and a second side direction guide for providing directional guidance of the length of lace from the first side upper strap to the first side lower strap and from the second side upper strap to the second side lower strap respectively;

wherein the lace extends laterally from the lacing device movably attaching to a first free end of the first side upper strap segment, returning and movably attaching to the first side directional guide, extending laterally away from the rear portion movably attaching to a second free end of the second side lower strap segment, extending back towards the rear portion, extending laterally across the rear portion and movably attaching with the second side lower strap segment, returning and movably attaching to the second side directional guide, extending laterally away from the rear portion and movably attaching to the second side upper strap segment, and returning back to the lacing device;

wherein the rear portion comprises an inner layer and an exterior layer forming an inner compartment, wherein the exterior layer comprises a first side and a second side upper lateral guides for providing directional guidance and limiting vertical travel of the length of lace extending away from the lacing device to the respective first and second side upper strap segments; and wherein the exterior layer further comprises at least one lower side lateral guide for providing limiting vertical travel of the length of lace extending between the first side lower strap segment to the second side lower strap segment.

21. The helmet retention system of claim 20, wherein the first side and the second side upper lateral guides each comprise a plurality of laterally positioned guide holes providing ingress and egress to and from the inner compartment, wherein the length of lace is woven from the lacing device through a first guide hole leading to the inner compartment for a brief segment, then exiting through a second guide hole, then laterally to the respective first and second upper strap segments; and wherein the lower side lateral guide comprises at least two laterally positioned guide holes providing ingress and egress to and from the inner compartment, wherein the length of lace is woven from the first side lower strap segment through a first guide hole leading to the inner compartment for a brief segment, then exiting through a second guide hole, and extending to the second side lower strap segment.

22. The helmet retention system of claim 21, wherein each strap segment comprises an attachment portion that movably attaches to a portion of the length of lace, wherein the portion of the length of lace is moved through the attachment portion and the strap segment is moved toward the rear portion when the length of lace is retracted into the lacing device.

23. The helmet retention system of claim 22, wherein the rear portion extends below a rear edge of the helmet shell such that it is exposed and accessible to the user when wearing the helmet.

24. The helmet retention system of claim 23, wherein the retention system further comprises at least one comfort pad at least partially surrounding the strap.

25. The helmet retention system of claim 20, further comprising a supplemental nape pad operably attached interior of the rear portion.

* * * * *